US008863677B2

(12) United States Patent
Fukao

(10) Patent No.: US 8,863,677 B2
(45) **Date of Patent: *Oct. 21, 2014**

(54) MULTI-NEEDLE SEWING MACHINE

(75) Inventor: Hiroaki Fukao, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 938 days.

This patent is subject to a terminal disclaimer.

(21) Appl. No.: 13/016,352

(22) Filed: Jan. 28, 2011

(65) Prior Publication Data

US 2011/0185957 A1 Aug. 4, 2011

(30) Foreign Application Priority Data

Feb. 1, 2010 (JP) ..... 2010-020230

(51) Int. Cl.

| | |
|---|---|
| ***D05B 1/08*** | (2006.01) |
| ***D05B 3/02*** | (2006.01) |
| ***D05C 11/10*** | (2006.01) |
| ***D05C 3/02*** | (2006.01) |

(52) U.S. Cl.

CPC *D05B 3/02* (2013.01); *D05C 11/10* (2013.01); *D05C 3/02* (2013.01)

USPC ..... 112/163

(58) Field of Classification Search

USPC ..... 112/98, 163, 254, 255, 258, 259, 270, 112/279, 302; 242/169, 170, 172, 118

See application file for complete search history.

(56) References Cited

U.S. PATENT DOCUMENTS

| | | | |
|---|---|---|---|
| 1,730,431 A | 10/1929 | Keefer | |
| 2,940,685 A | 6/1960 | Glass | |
| 4,351,458 A | 9/1982 | Wolfe | |
| 5,063,866 A | 11/1991 | Jimenez et al. | |
| 7,114,455 B2 | 10/2006 | Prufer et al. | |
| 8,251,000 B2 | 8/2012 | Fukao et al. | |

(Continued)

FOREIGN PATENT DOCUMENTS

| | | | | |
|---|---|---|---|---|
| GB | 191505668 | * | 0/1915 | ..... D05B 51/00 |
| JP | A-56-73765 | | 6/1981 | |

(Continued)

OTHER PUBLICATIONS

Jul. 9, 2013 Office Action issued in Japanese Patent Application No. 2010-020230 (with translation).

(Continued)

*Primary Examiner* — Tejash Patel
(74) *Attorney, Agent, or Firm* — Oliff PLC

(57) ABSTRACT

A multi-needle sewing machine is disclosed that includes a needle-bar case that supports needle bars; a needle-bar case transfer mechanism that transfers the needle-bar case to place a predetermined needle bar to a needle drop position; a thread guide member that is movable up and down, the thread guide member being provided with thread guide sections spaced by a predetermined distance and that guide a plurality of threads; a plurality of thread inlets that are provided at the needle-bar case, each thread inlet being uniquely associated with one of the thread guide sections and that introduces the threads guided by the thread guide sections toward the needle bars; and a lifting/lowering mechanism that moves the thread guide member up and down during transfer of the needle-bar ease and the thread inlets such that the thread guide sections and the associated thread inlets maintain a constant distance therebetween.

15 Claims, 27 Drawing Sheets

(56) References Cited

U.S. PATENT DOCUMENTS

| | | | | |
|---|---|---|---|---|
| 8,464,651 | B2 * | 6/2013 | Fukao | 112/270 |
| 8,651,035 | B2 * | 2/2014 | Fukao | 112/163 |
| 2011/0011318 | A1 | 1/2011 | Fukao | |
| 2011/0011319 | A1 | 1/2011 | Fukao | |

FOREIGN PATENT DOCUMENTS

| | | |
|---|---|---|
| JP | U-58-98074 | 7/1983 |
| JP | U-60-27877 | 2/1985 |
| JP | U-60-30779 | 3/1985 |
| JP | U-05-44073 | 8/1993 |
| JP | U-06-036585 | 5/1994 |
| JP | U-06-046676 | 6/1994 |
| JP | A-06-312073 | 11/1994 |
| JP | U-06-081478 | 11/1994 |
| JP | A-08-71278 | 3/1996 |
| JP | A-2000-008265 | 1/2000 |
| JP | A-2000-126487 | 5/2000 |
| JP | A-2000-126488 | 5/2000 |
| JP | A-2004-242980 | 9/2004 |
| JP | A-2004-261413 | 9/2004 |
| JP | A-2006-061179 | 3/2006 |
| JP | A-2006-193240 | 7/2006 |
| JP | U-3138430 | 12/2007 |
| JP | A-2010-220846 | 10/2010 |
| JP | A-2011-19699 | 2/2011 |
| JP | A-2011-19700 | 2/2011 |

OTHER PUBLICATIONS

Mar. 8, 2011 Office Action issued in Japanese Patent Application No. 2009-071927 (with translation).

Apr. 19, 2011 Office Action issued in Japanese Patent Application No. 2009166770 (with translation).

Dec. 20, 2012 Office Action issued in U.S. Appl. No. 12/801,507.

Japanese Office Action issued in Japanese Patent Application No. 2009-071927 on Nov. 24, 2010 (with translation).

U.S. Appl. No. 12/697,856, filed Feb. 1, 2010.

U.S. Appl. No. 12/801,507, filed Jun. 11, 2010.

U.S. Appl. No. 12/830,776, filed Jul. 6, 2010.

Office Action dated Jan. 20, 2012 issued in U.S. Appl. No. 12/830,776.

* cited by examiner

MULTI-NEEDLE SEWING MACHINE

CROSS-REFERENCE TO RELATED APPLICATIONS

This application is based upon and claims the benefit of priority from the prior Japanese Patent Application 2010-020230, filed on Feb. 1, 2010, the entire contents of which are incorporated herein by reference.

FIELD

The present disclosure relates to a multi-needle sewing machine provided with a needle-bar case transfer mechanism that transfers a needle-bar case containing a plurality of needle bars.

BACKGROUND

In the field of sewing machines, a multi-needle sewing machine is known that forms multi-color embroidery patterns with multiple needle bars. Such multi-needle sewing machine is provided with a needle-bar case containing multiple needle bars having a sewing needle attached to their lower ends. The needle-bar case is laterally transferred to locate a given needle bar at the sewing position, i.e., the needle drop position for execution of a sewing operation. The problem often encountered in such multi-needle sewing machine was needle thread tangling. Because the sewing machine utilizes multiple needle threads drawn from multiple thread spools, the strands of loose needle threads often entangled in the absence of appropriate tension management.

One solution to overcome this problem was preventing interference of threads by passing each thread through a thin elongate tube. However this required a troublesome task of passing the threads through the thin tubes.

SUMMARY

One object of the present disclosure is to provide a multi-needle sewing machine that prevents thread tangling without a troublesome task of having to pass the thread through thin elongate tubes.

In aspect a multi-needle sewing machine includes a plurality of needle bars each allowing attachment of a sewing needle to a lower end thereof; a needle-bar case that supports the needle bars so as to be movable up and down; a needle-bar case transfer mechanism that transfers the needle-bar case to place a predetermined needle bar selected from the plurality of needle bars to a needle drop position; a sewing machine frame; a support frame that supports the sewing machine frame; a thread guide member that is movable up and down and that is provided on an upper end of the support frame, the thread guide member being provided with a plurality of thread guide sections that are spaced by a predetermined distance and that guide a plurality of threads being drawn form a plurality of thread spools provided at the sewing machine frame; a plurality of thread inlets that are provided at the needle-bar case, each of the thread inlets being uniquely associated with one of the thread guide sections and that introduces the threads guided by the thread guide sections toward the needle bars; and a lifting/lowering mechanism that moves the thread guide member up and down during transfer of the needle-bar case and the thread inlets such that the thread guide sections and the associated thread inlets maintain a constant distance therebetween.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

One exemplary embodiment of the present disclosure will be described with reference to FIGS. 1 to 26. It is to be noted that in FIG. 1, the direction in which the user positions him/herself relative to the sewing machine is the forward direction which is the direction normal to the page.

Figure 1:
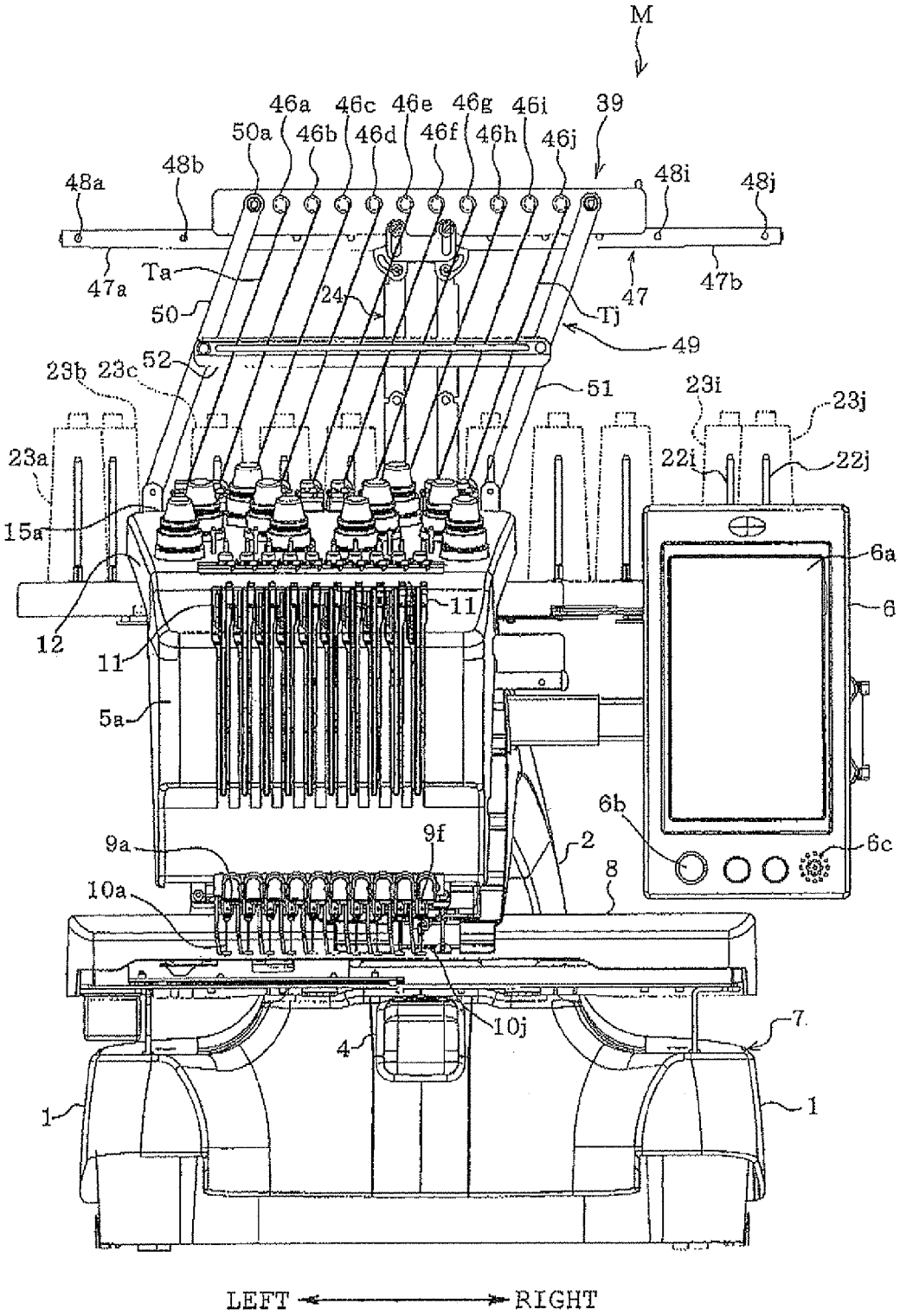
FIG. 1 is a front view of a multi-needle sewing machine in its entirety according to a first exemplary embodiment of the present disclosure.
Figure 2:
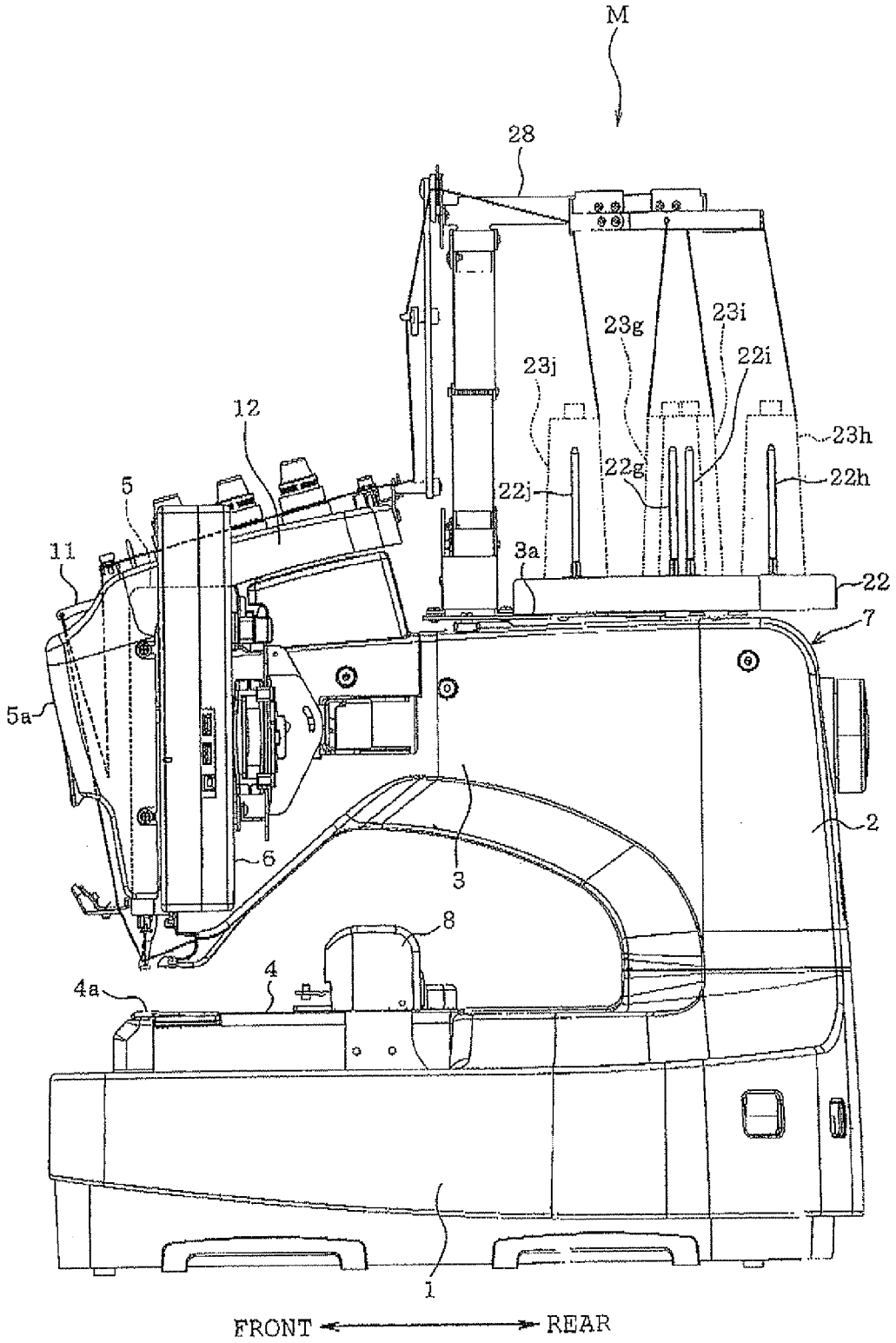
FIG. 2 is a right side view of the entire sewing machine.
Figure 6:
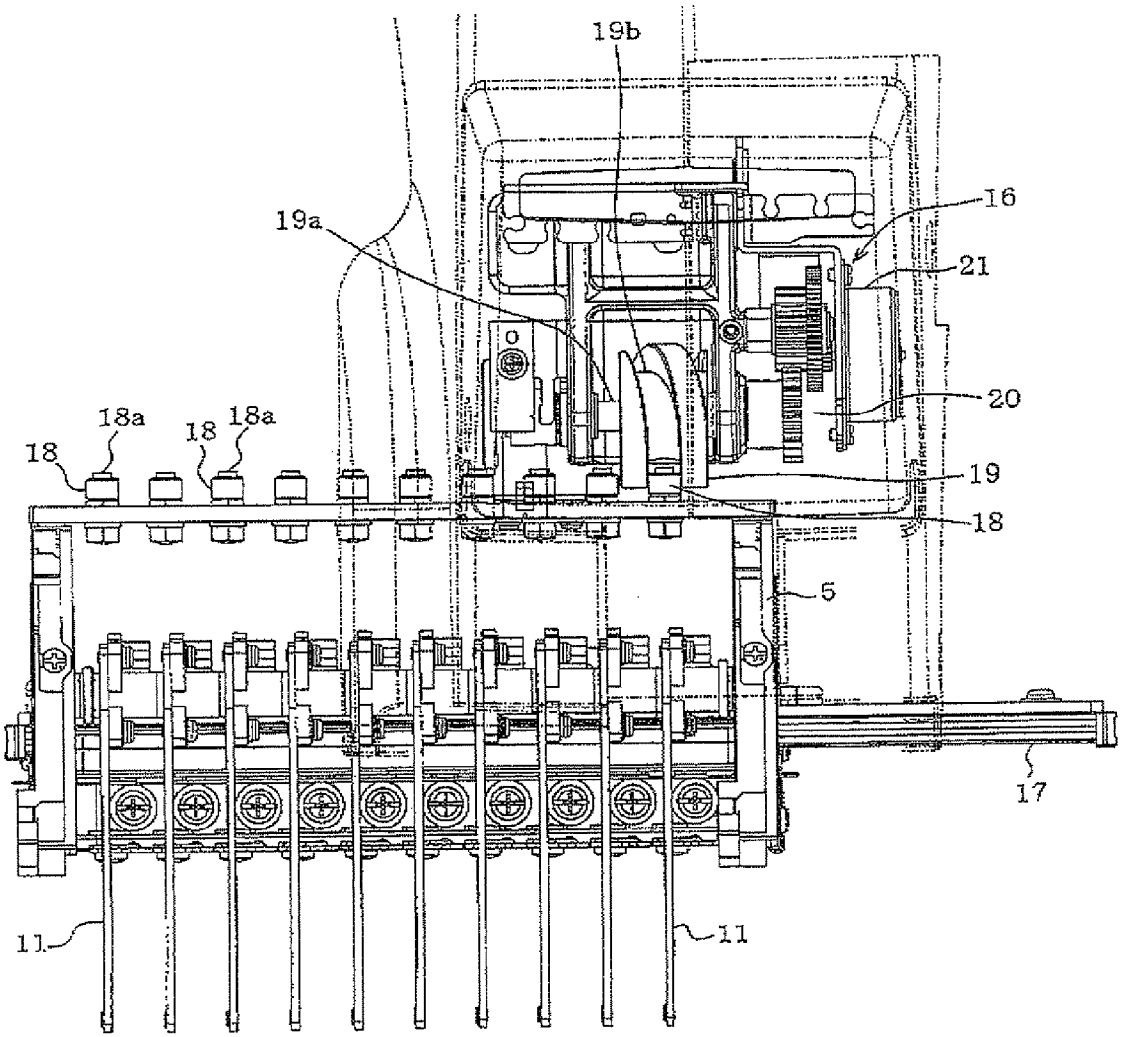
FIG. 6 is a front view of a needle-bar case transfer mechanism.

Referring to FIGS. 1 to 4, multi-needle sewing machine M is primarily configured by a pair of left and right feet 1, pillar 2, aim 3, cylinder bed 4, and needle-bar case 5. Feet 1 supports multi-needle sewing machine M in its entirety and pillar 2 stands substantially upright from the rear end of feet 1. From the upper portion of pillar 2, arm 3 extends forward so as to oppose cylinder bed 4 extending forward from the lower end of pillar 2. Needle-bar case 5 is attached on the front face of arm 3 as can be seen in FIGS. 2 and 6.

Feet 1, pillar 2, arm 3, and cylinder bed 4 are structurally integral and are collectively referred to as sewing machine body 7. Components such as a later described controller 56 shown in FIG. 26 responsible for overall control of multi-needle sewing machine M and control panel 6 are provided at seeing machine body 7.

Figure 26:
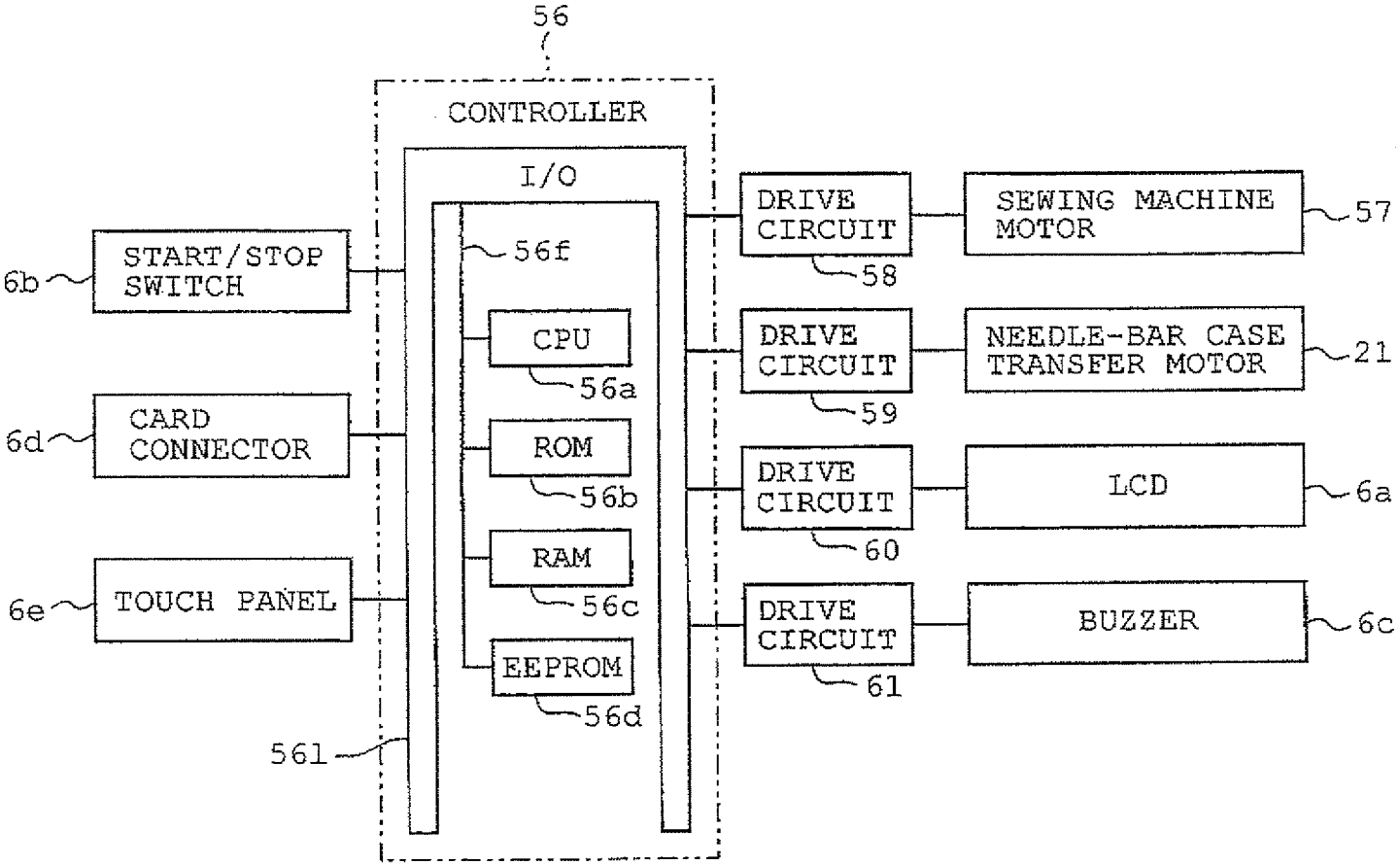
FIG. 26 is a block diagram of a control system of the multi-needle sewing machine according to the first exemplary embodiment.

Control panel 6 includes a vertically long liquid crystal display (LCD) 6*a* that displays various information required in a sewing operation. At the lower front face of control panel 6, various switches such as a start/stop switch 6*b* are provided for user operation as well as buzzer 6*c*. As shown in FIG. 26, various interfaces such as a card connector 6*d* for insertion of a memory card not shown is provided on the sidewall of control panel 6. Still referring to FIG. 26, a touch panel 6*e* including a plurality of touch keys configured by transparent electrodes are provided on the front face of LCD 6*a*. The user is allowed to perform various controls through touch key operation such as selection of embroidery patterns to be sewn and providing various instructions for execution of the sewing operation.

On the upper surface of cylinder bed 4, needle plate 4*a* shown in FIG. 2 is provided that has a needle hole not shown and that may also be referred to as a needle drop position of a later described sewing needles 10*a* to 10*j* shown in FIG. 5.

Above feet 1, carriage 8 oriented in the left and right direction is disposed which contains an X-drive mechanism not shown that drives a frame mount base not shown provided in front of carriage 8 in the X direction or the left and right direction. Within the left and right feet 1, a Y-direction drive mechanism is provided that drives carriage 8 in the Y direction or the front and rear direction. The workpiece cloth not shown to be embroidered is held by a rectangular embroidery frame not shown which is mounted on the frame mount base. The embroidery frame being driven by the Y-direction drive mechanism and the X-direction drive mechanism is transferred in the Y direction in synchronism with carriage 8 or in the X direction along with the frame mount base, to allow the workpiece cloth to be fed.

Figure 4:
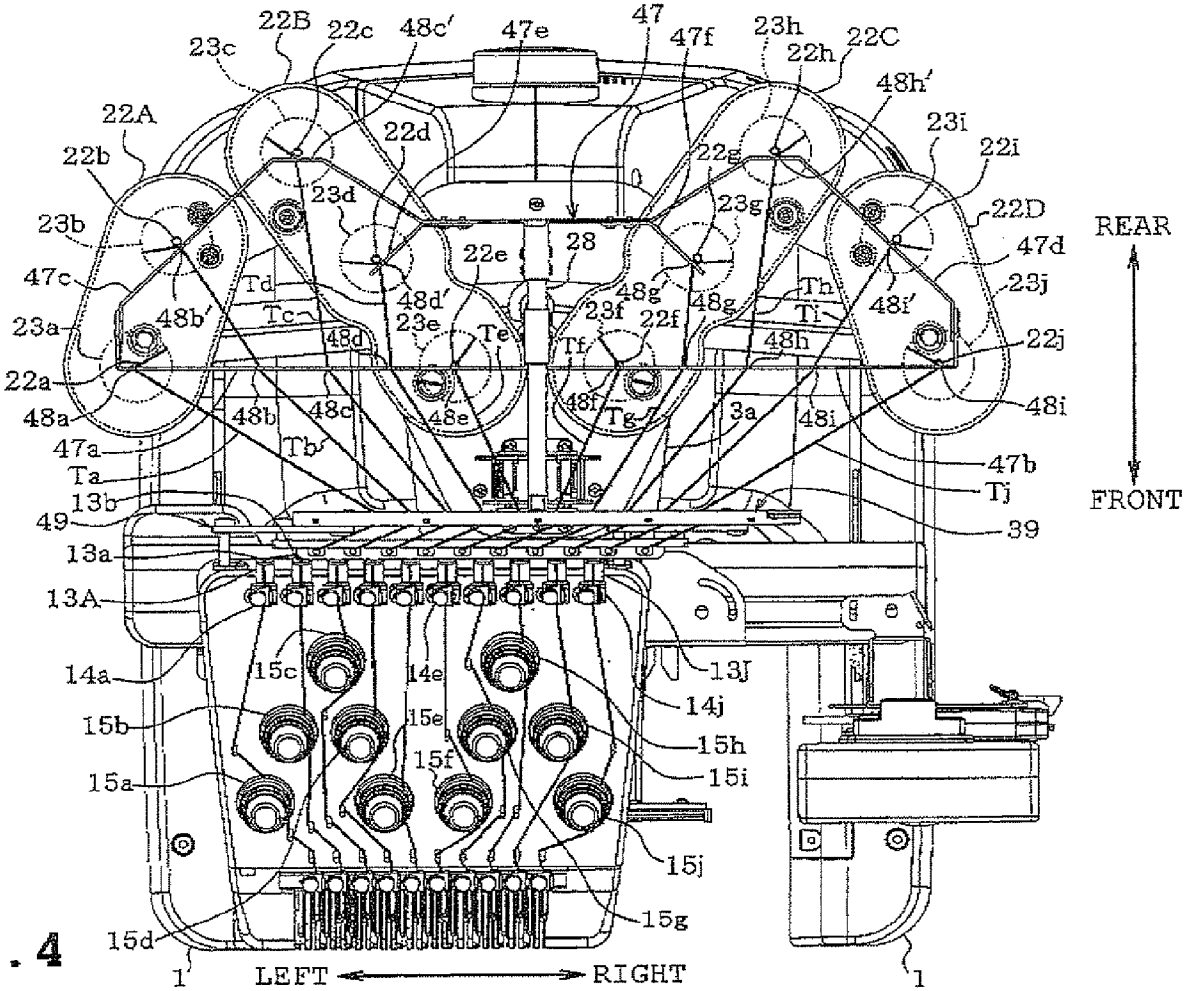
FIG. 4 is a plan view of the entire sewing machine.
Figure 5:
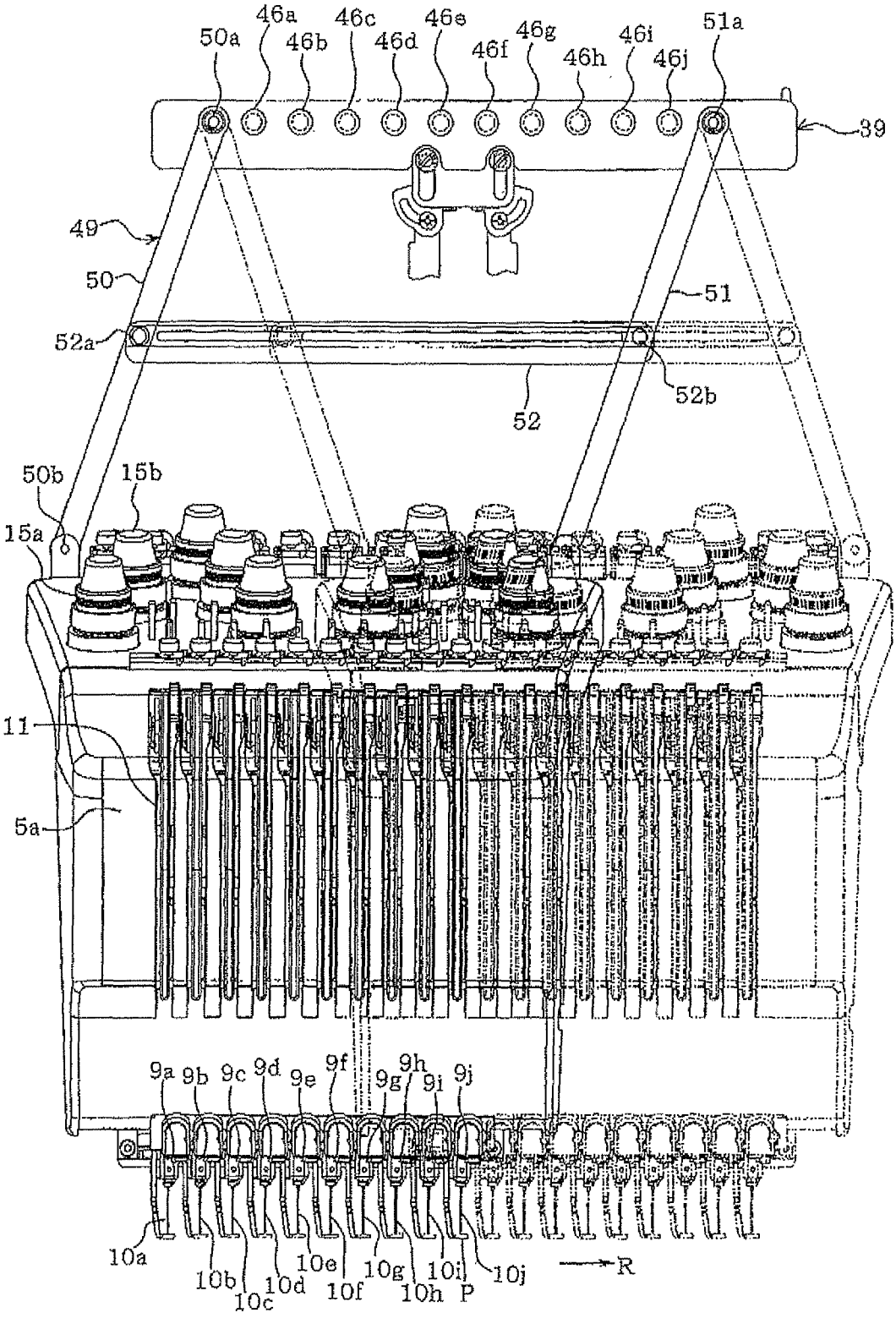
FIG. 5 is a partial front view showing a range of component residing between a thread guide member and sewing needles.
Figure 19:
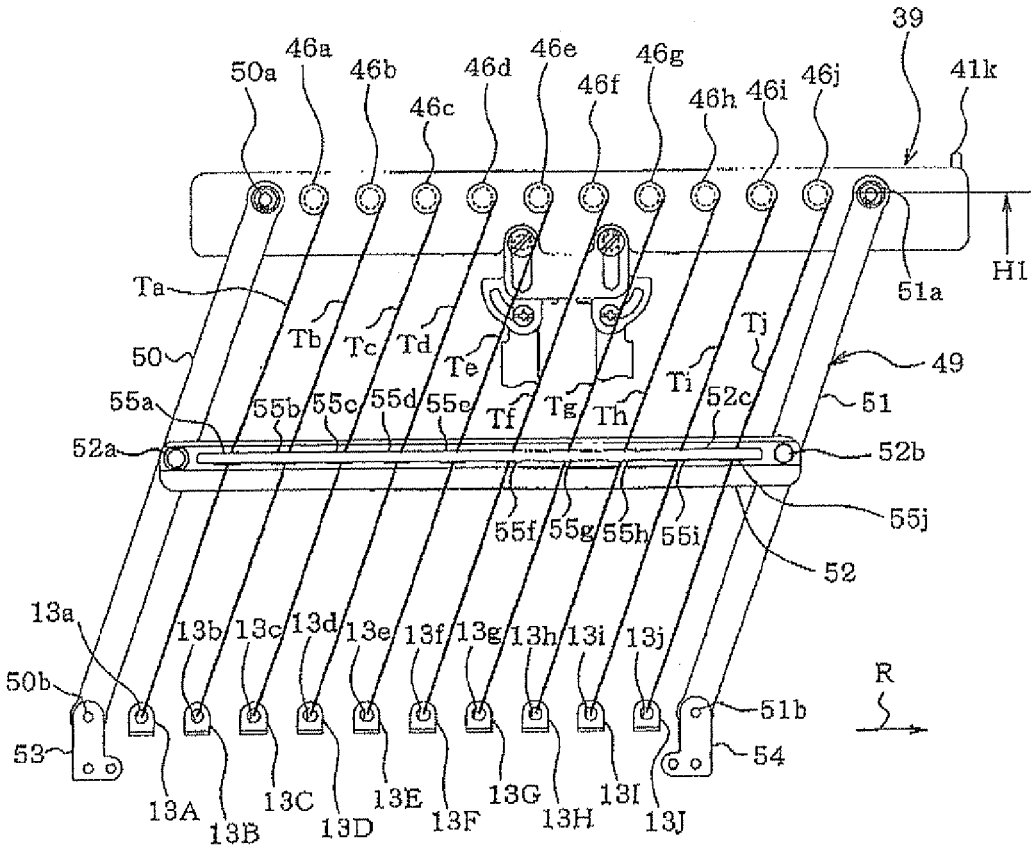
FIG. 19 is a front view of lifting/lowering mechanism.

As shown in FIG. 5, needle-bar case 5 supports ten vertically extending needle bars 9*a* to 9*j* that are arranged side by side in the left and right direction. Needle bars 9*a* to 93 are allowed to move up and down and each needle bar 10 has sewing needle 10*a* to 10*j* attached to its lower end. Needle-bar case 5 is further provided with ten thread take-ups 11 that are associated with the ten needle bars 9*a* to 9*j*. Thread take-ups 11 are also allowed to move up and down. Needle-bar case 5 has a synthetic resin cover 5*a* attached on its front side and a forwardly declining thread tension regulator base 12 on its upper side that merges in continuation with the upper end of cover 5*a*. At the rear end of thread tension regulator base 12, ten thread guides 13A to 13J each provided with thread inlet 13*a* to 13*j* are laterally aligned as shown in FIGS. 4 and 19. Referring to FIG. 4, thread guides 14*a* to 14*j*, only 14*a*, 14*e*, and 14*j* are identified with reference symbols due to special limitations, are provided in front of thread inlets 13*a* to 13*j*. Still referring to FIG. 4, thread tension base 12 is provided with 10 thread tension regulators 15*a* to 15*j* for adjusting thread tension of needle thread being supplied to each of sewing needles 10*a* to 10*j*.

Figure 7:
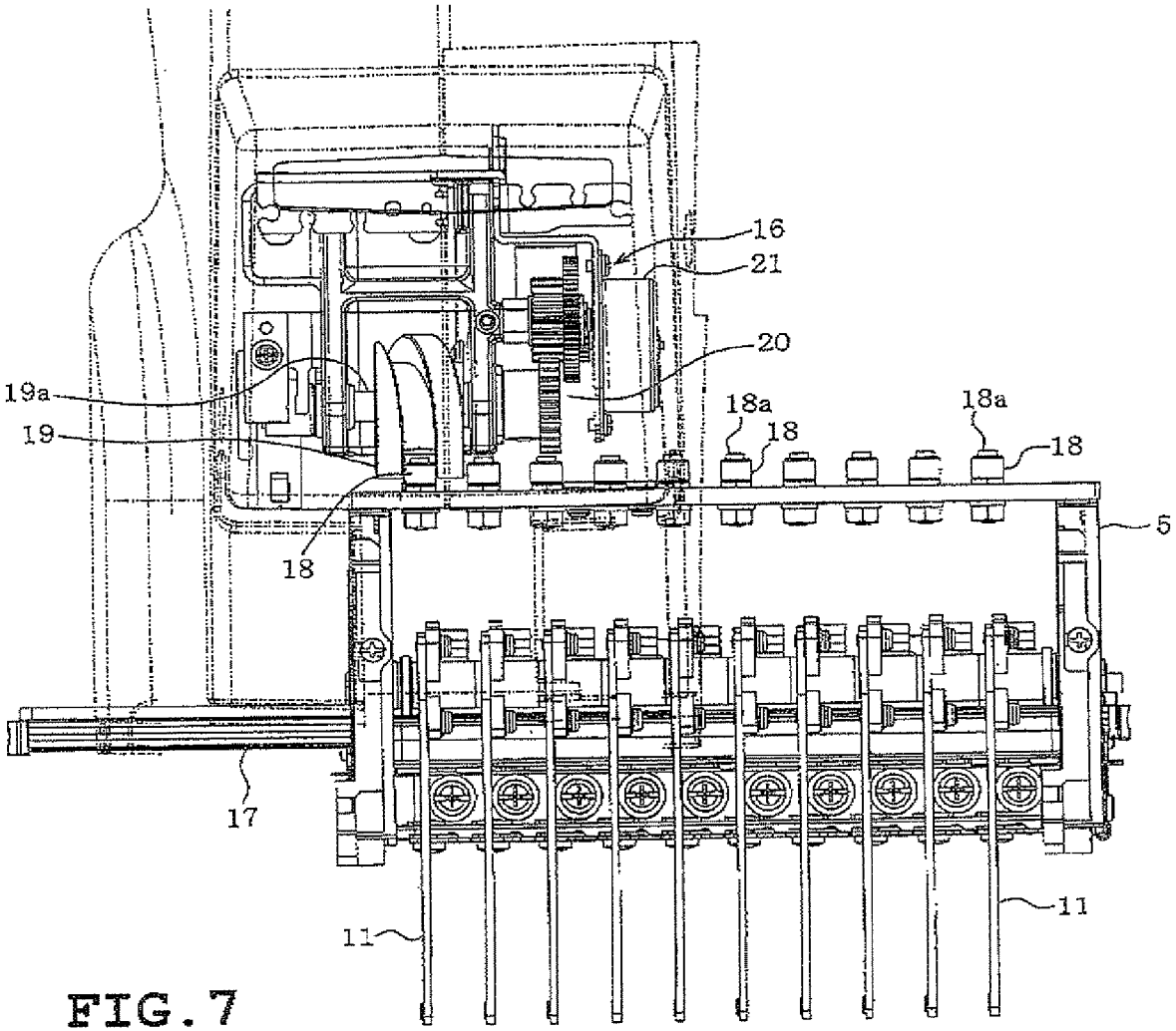
FIG. 7 is another front view of the needle-bar case transfer mechanism which is a variation of FIG. 6.
Figure 8:
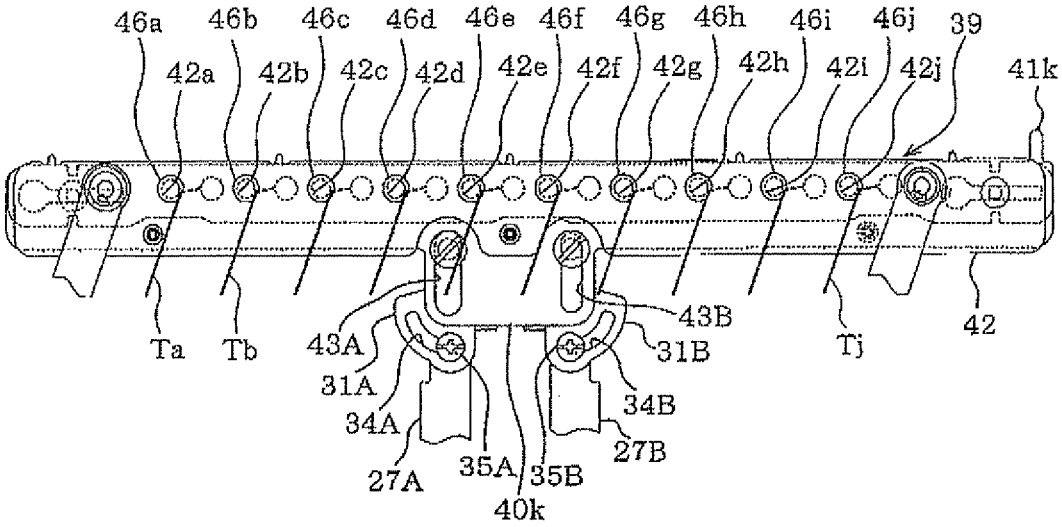
FIG. 8 is a front view of the thread guide member.
Figure 9:
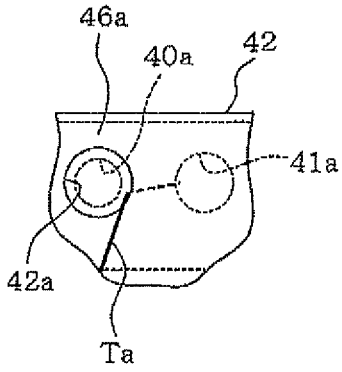
FIG. 9 is an enlarged front view of the thread guide member.
Figure 10:
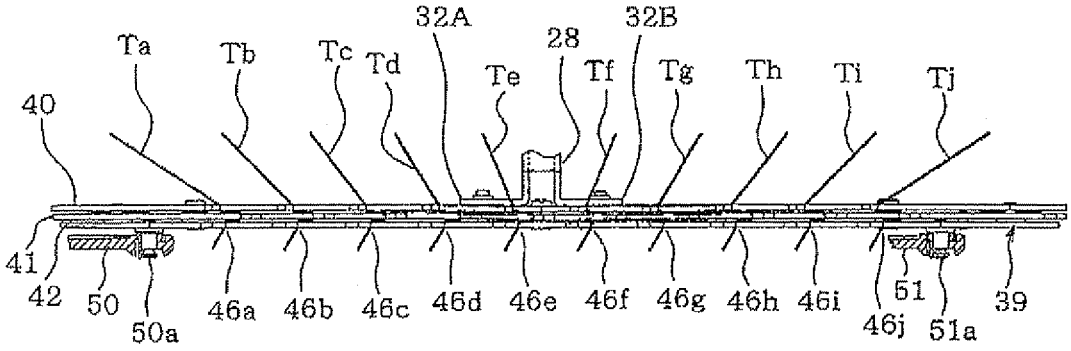
FIG. 10 is a plan view of the thread guide member.

Needle-bar case transfer mechanism 16 shown in FIGS. 6 and 7 selectively switches one of ten needle bars 9*a* to 9*j* within needle-bar case 5 to a needle drop position by laterally transferring needle-bar case 5. Needle-bar case transfer mechanism 16 is configured by components such as guide rail 17, roller 18, spiral cam 19, deceleration gear 20, and needle-bar case transfer motor 21. Guide rail 17, extending laterally at the front end of arm 3, allows needle-bar case 5 to slide along it.

At the upper rear end of needle-bar case 5, ten rollers 18 are laterally aligned so as to protrude toward the front end upper surface of arm 3. Ten rollers 18 are spaced equally with the spacing between ten needle bars 9*a* to 9*j*. Rollers 18 are supported rotatably by longitudinally extending roller shafts 18*a*.

On the upper surface of arm 3, a laterally oriented shaft 19*a* is provided that has spiral cam 19 coupled to it. Spiral cam 19 is configured to rotate integrally with shaft 19*a*. The rotation of needle-bar case transfer motor 21 is transmitted to shaft 19*a* by way of deceleration gear 20. Spiral cam 19 has spiral groove 19*b* defined on it for allowing engagement of at least one of the ten rollers 18.

When needle-bar case transfer motor 21 is driven in rotation in a first direction, spiral cam 19 rotates responsively in the first direction as well. With the rotation of spiral cam 19, at least one of rollers 18 engaged with spiral groove 19*b* is rotated clockwise to cause needle bar 5 to transfer needle-bar case 5 to the right. When needle-bar case transfer motor 21 is driven in rotation in a second direction opposite the first direction, needle-bar case 5 is transferred to the left.

Needle-bar case transfer mechanism 16 transfers needle-bar case 5 in the left and right direction relative to sewing machine body 7 to selectively switch one of the 10 pairs of needle bars 9*a* to 9*j* and corresponding thread take-ups 11 to the needle drop position. The selected pair of needle bar 9*a* to 9*j* and thread take-up 11 is driven up and down in synchronism by sewing machine motor 57 shown in FIG. 26 while co-operating with rotary shuttle not shown provided at the front end of cylinder bed 4 to form embroidery stitches on the workpiece cloth held by the embroidery frame.

Figure 3:
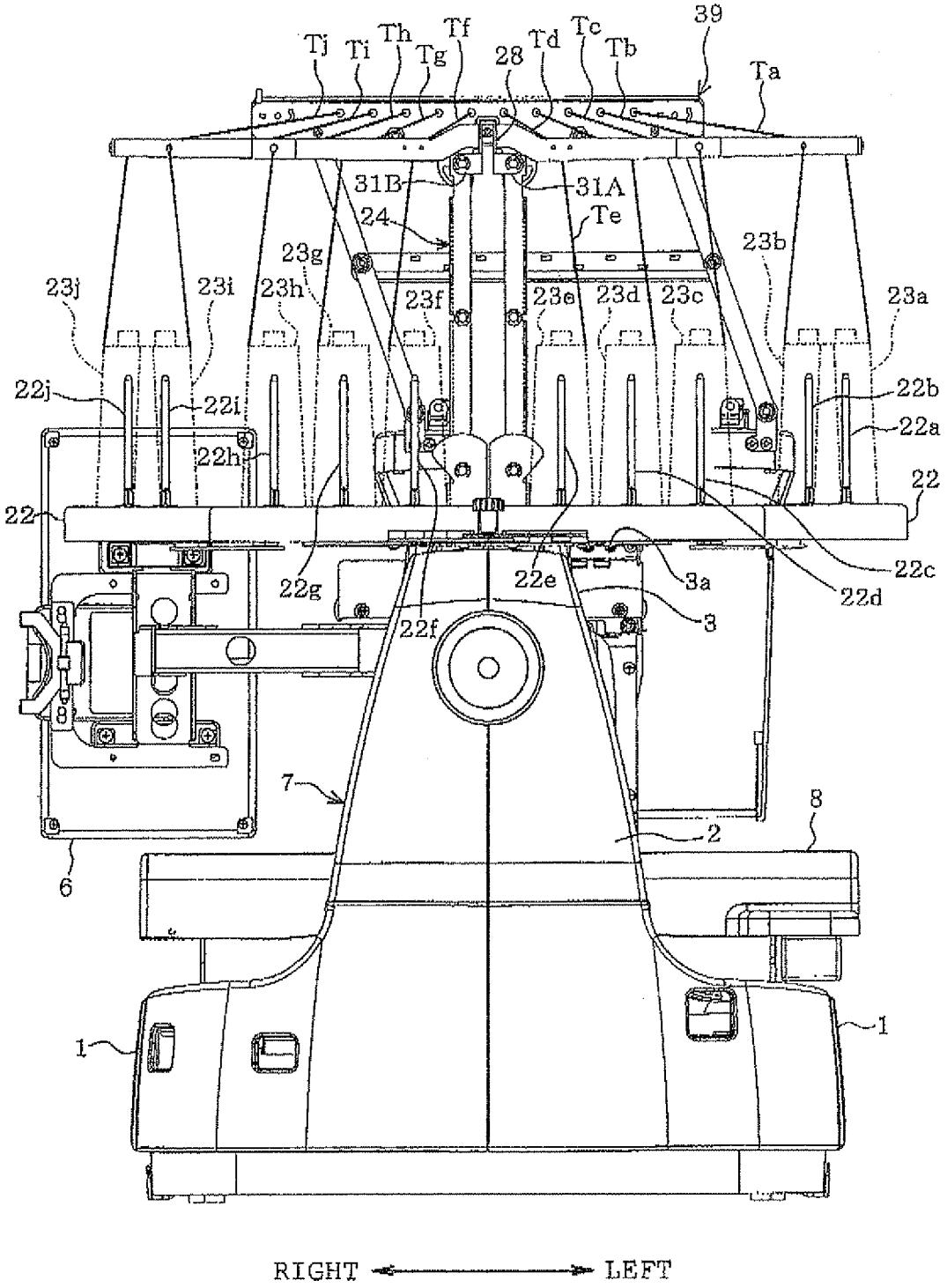
FIG. 3 is a rear side view of the entire sewing machine.

Fixture frame 3*a* serving as a sewing machine frame is mounted an arm 3 of sewing machine body 7. As can be seen in FIGS. 3 and 4, thread spool stands 22A to 22D are provided over fixture frame 3*a*. Ten thread spool pins 22*a* to 22*j* for holding thread spools 23*a* to 23*j* are distributed to thread spool stands 22A to 22D.

Figure 24:
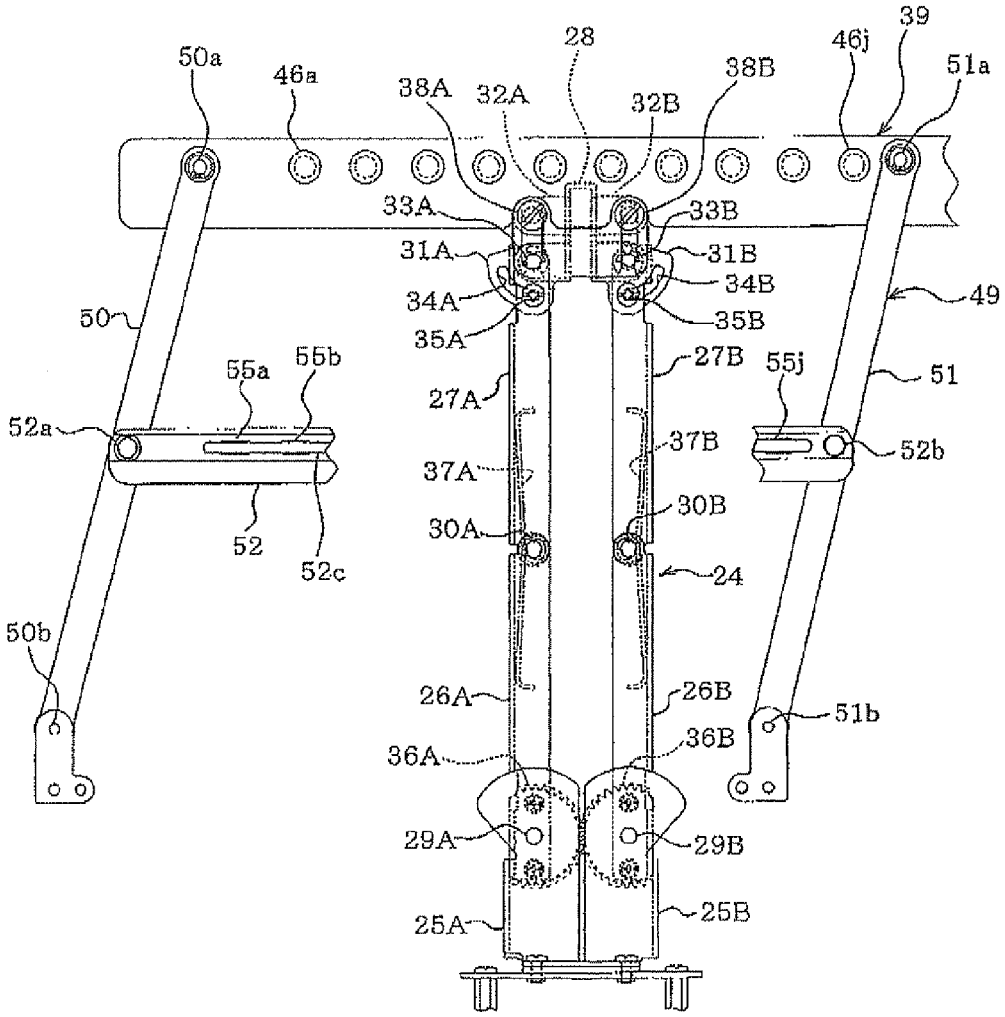
FIG. 24 is a front view of the support frame.
Figure 25:
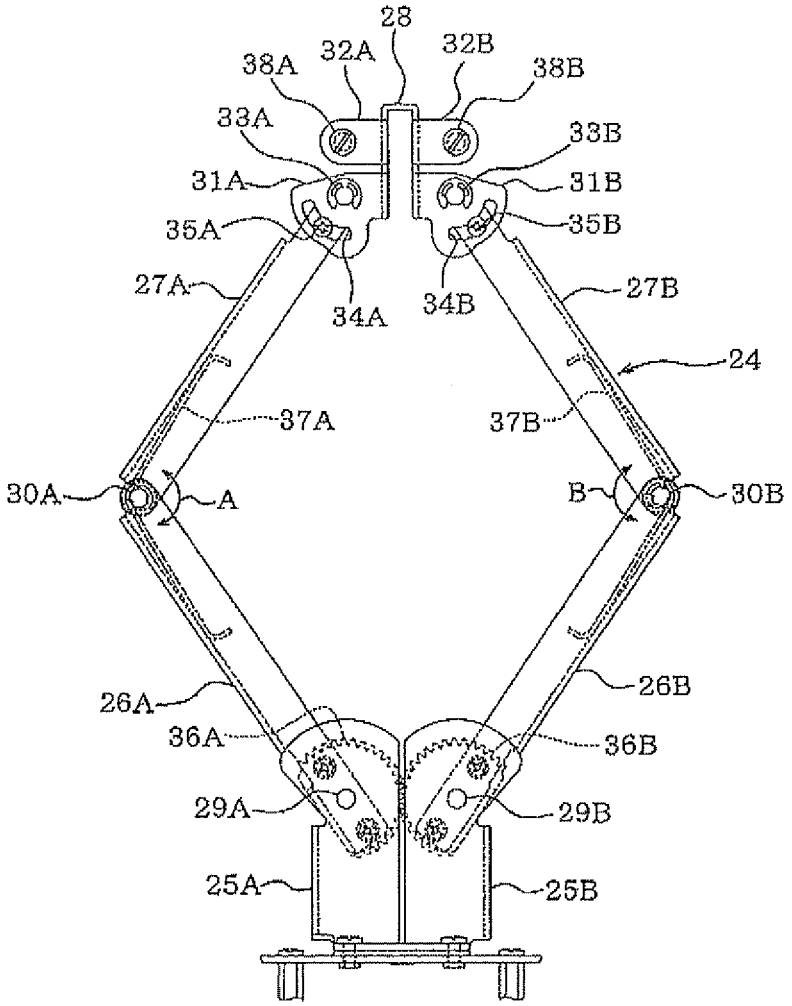
FIG. 25 is a front view the support frame under height adjustment.

On the front portion of fixture frame 3*a*, support frame 24 is provided which is adjustable in height as shown in FIGS. 24 and 25. Support frame 24 is primarily composed of base sections 25A and 25B, lower frame sections 26A and 26B, upper frame sections 27A and 273, and upper support section 28 which serves as the upper end of support frame 24.

Base sections 25A and 25B are secured on fixture frame 3*a* and lower ends of lower frame sections 26A and 263 are pivotably coupled to base sections 25A and 253 by way of shafts 29A and 29B. Upper ends of lower frame sections 26A and 26B are pivotably coupled to the lower ends of upper support frames 27A and 27B by shafts 30A and 30B.

Upper support section 28 extends in the front and rear direction and has reverse U-shaped cross section when viewed from the front side. On the front portion of upper support section 28, upper frame section attachments 31A and 31B spread out to the left and right and thread guide attachments 32A and 32B spread out to the left and right above upper frame section attachments 31A and 31B.

Upper frame section attachment 31A is pivotably attached to the upper end of upper frame section 27A by shaft 33A, whereas upper frame section attachment 31B is pivotably attached to the upper and of upper frame section 27B by shaft 339.

Upper frame section attachment 31A has a circumferential slot 34A which is defined around shaft 33A. Circumferential slot 34A receives screw 35A which is threaded into upper frame section 27A. Similarly, upper frame section attachment 31B has a circumferential slot 34B which is defined around shaft 33B. Circumferential slot 34B receives screw 35B which is threaded into upper frame section 27B.

On the lower portion of lower frame section 26A, sector gear 36A is mounted so as to center on shaft 29A. Similarly, on the lower portion of lower frame section 265, sector gear 36B is mounted so as to center on shaft 29B. Sector gears 36A and 36B are meshed. Twisted coil spring 37A is wound on shaft 30A and urges lower frame section 26A and upper frame section 27A in the direction indicated by arrow A. Twisted coil spring 3713 is wound on shaft 30B and urges lower frame section 26B and upper frame section 275 in the direction indicated by arrow B.

Support frame 24, being fully stretched in FIG. 24, can be adjusted in height by loosening screws 35A and 35B. FIG. 25 shows an example where support frame 24 is slightly lowered in height. In the present exemplary embodiment, screws 35A and 35B are tightened to look upper frame sections 27A and 27B with upper frame section attachments 31A and 31B to place support frame 24 in a fully stretched posture as shown in FIG. 24. Support frame 24 is configured to be adjustable in height as described above.

Figure 13:
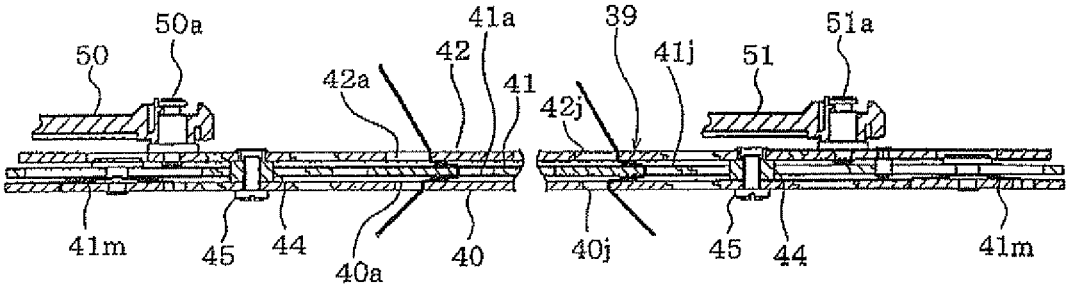
FIG. 13 is an enlarged transverse cross-sectional view of the extremities of the thread guide member.
Figure 14:
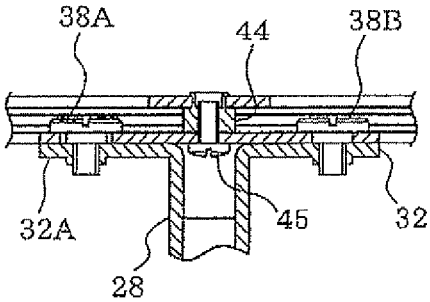
FIG. 14 is a transverse cross-sectional view of the interface of the thread guide member and the support frame.
Figure 15:
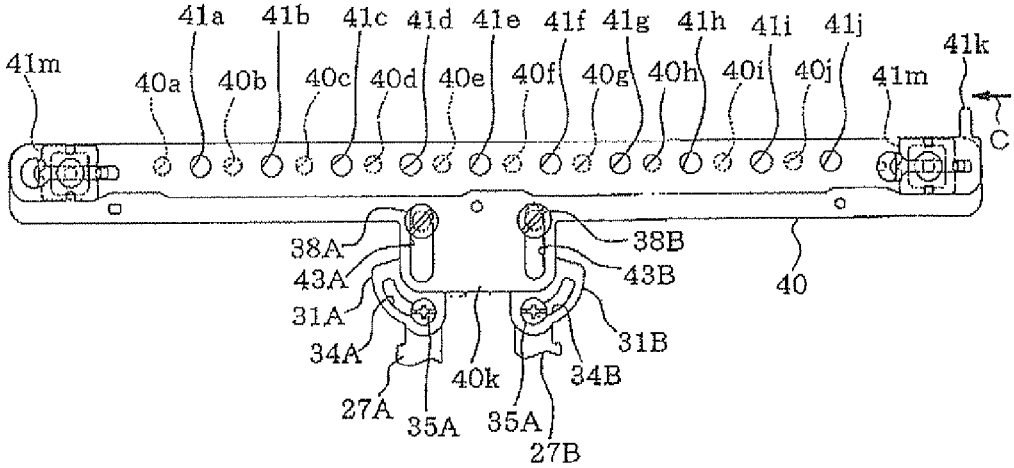
FIG. 15 is a front view of the thread guide member with the foremost panel removed.
Figure 16:
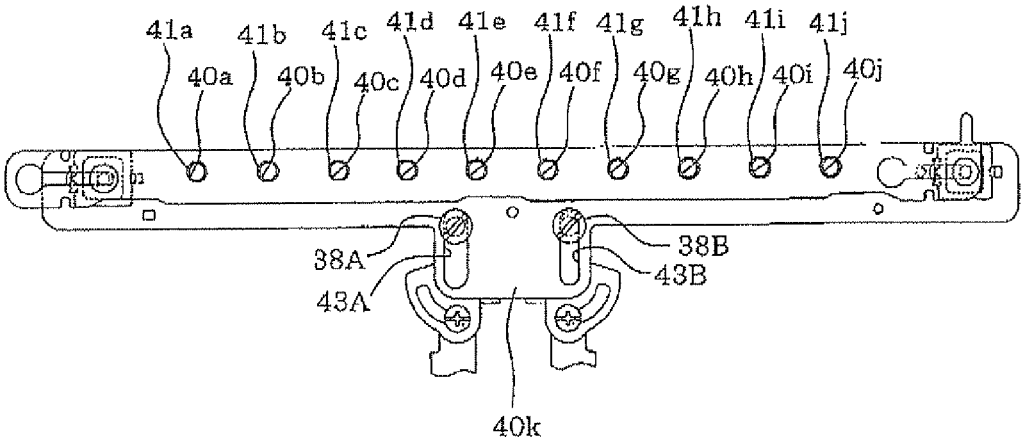
FIG. 16 is another front view of the thread guide member with the foremost panel removed which is a variation of FIG. 15.
Figure 17:
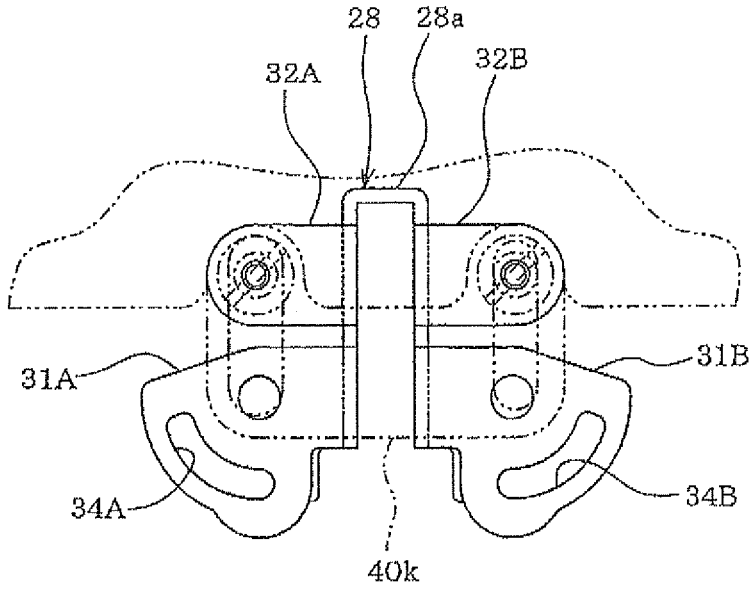
FIG. 17 is a front view of the upper portion of the support frame.
Figure 18:
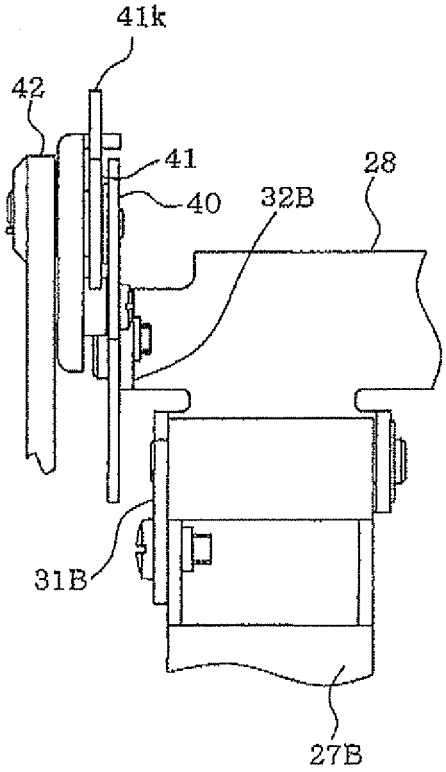
FIG. 18 is a side view of the upper portion of the support frame.

Thread guide attachments 32A and 32B of support frame 24 has thread guide member 39 attached movably up and down by stepped screws 38A and 38B. As shown in FIGS. 8 to 18, thread guide member 39 is made by stacking three pieces of elongate panels 40, 41, and 42 in the front and rear direction. The rearmost panel 40 and the foremost panel 42 are coupled by spacer 44 and screw 45 as shown in FIG. 13 so as to leave a clearance therebetween to allow middle panel 41 to move in the left and right direction.

Rearmost panel 40 has ten equally spaced thread insert holes 40*a* to 40*j* defined on it. At the central lower portion of panel 40, attachment 40*k* is provided which has a pair of parallel long holes 43A and 43B running up and down. The widths of long holes 43A and 43B are dimensioned to be slightly wider than the outer diameters of the stepped portion of stepped screws 38A and 38B. The width of long hole 43A located on the left side in the accompanying drawings is dimensioned to be slightly wider than the width of long hole 43B to allow smooth vertical movement of thread guide member 39 while prohibiting lateral movement.

Foremost panel 42 has thread insert holes 42*a* to 42*j* defined on it that opposes thread insert holes 40*a* to 40*j* formed on rearmost panel 40.

Middle panel 41 is provided laterally movably between foremost panel 42 and rearmost panel 40.

Middle panel 41 has thread insert holes 41*a* to 41*j* defined on it that are equally spaced with thread insert holes 40*a* to 40*j* of rearmost panel 40. On the right side portion of middle panel 41, dial 41*k* is provided for laterally moving middle panel 41. When the user turns dial 41*k* in the direction indicated by arrow C in FIG. 15, middle panel 41 is placed in the state shown in FIG. 16. In the state shown in FIG. 16, thread insert holes 41*a* to 41*j* of middle panel 41 opposes thread insert holes 40*a* to 40*j* of rearmost panel 40. The three sets of insert holes 40*a* to 40*j*, 41*a* to 41*j*, and 42*a* to 42*j* constitute thread guide section 46*a* to 46*j*.

Near the two lateral extremities of panel 41, friction appliers 41*m* made of leaf springs are provided to apply a certain level of friction when moving panel 41.

At the upper end of support frame 24, screws 38A and 38B being threaded into long holes 43A and 43B of rearmost panel 40 is further threaded into screw holes 32Aa and 32Bb of thread guide attachments 32A and 32B of support frame 24. Thread guide member 39 is thus, provided so as to be movable up and down.

Figure 11:
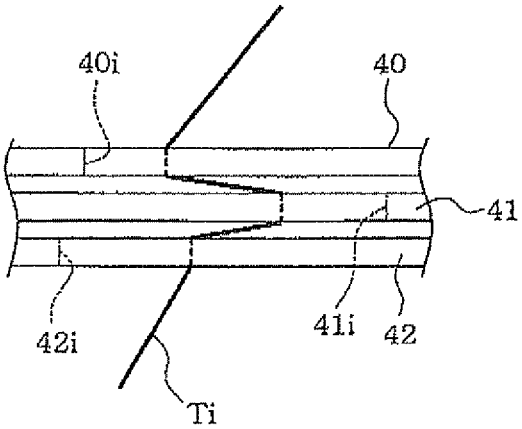
FIG. 11 is an enlarged plan view of the thread guide member.
Figure 12:
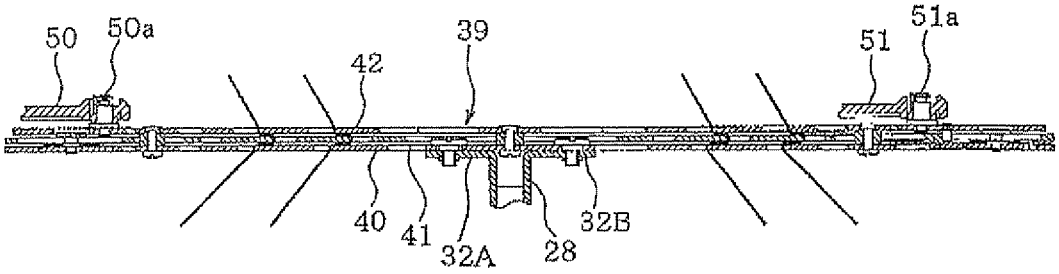
FIG. 12 is a transverse cross-sectional view of the thread guide member.

Referring to FIG. 11, the diameters of thread insert holes 40*a* to 40*j* of rearmost panel 40, thread insert holes 41*a* to 41*j* of middle panel 41, and thread insert holes 42*a* to 42*j* of foremost panel 42 are configured to increase in the listed sequence. The thread insert holes 40*a* to 40*j*, 41*a* to 41*j*, and 42*a* to 42*j* when positioned to confront each other, allows the user to readily insert the thread through them with ease.

As shown in FIG. 4, thread engagement section 47 is mounted on upper support section 28 of support frame 24 so as to be located behind thread guide member 39. Thread engagement section 47 comprises first panel 47*a* running in a straight line above thread spool pins 22*a* and 22*e*, a second panel 47*b* running in a straight line above thread spool pins 22*f* and 22*j*, a third panel 470 located above thread spool pins 22*b* and 22*c*, a fourth panel 47*d* running in a straight line above thread spool pins 22*i*1 and 22*h*, a fifth panel 47*e* located above thread spool pin 22*d*, and a sixth panel 47*f* located above thread pool pin 22*g*.

First panel 47*a* has thread engagement portions 48*a* to 48*b* formed as holes. Second panel 47*b* also has thread engagement portions 48*f* to 48*j* formed as holes. Thread engagement sections 48*a*, 48*e*, 48*f*, and 48*j* are located above thread spool pin 22*a*, 22*e*, 22*f* and 22*j*. Third panel 47*c* has thread engagement portions 48*b*' and 48*c*' formed as holes located above thread spool pins 22*b* and 22*c*. Fourth panel 47*d* has thread engagement portions 48*i*' and 48*h*' formed as holes located above thread spool pins 22*i* and 22*h*. Fifth panel 47*e* has thread engagement portion 48*d*' formed as holes located above thread spool pin 22*d*. Sixth panel 47*f* has thread engagement portion 48*g*' formed as holes located above thread spool pin 22*g*.

Thread guide member 39 is moved up and down by lifting/lowering mechanism 49. As shown in FIGS. 1 and 19 to 22, lifting/lowering mechanism 49 is provided with three elongate panels namely, a first link member 50, a second link member 51, and auxiliary member 52.

The upper end of first link member 50 is pivotably coupled to the left end of thread guide member 39 by way of shaft 50*a*, whereas the lower end of the first link member 51 is pivotably coupled to attachment 53 mounted on the left end of needle-bar case 5 by way of shaft 50*b*.

Figure 22:
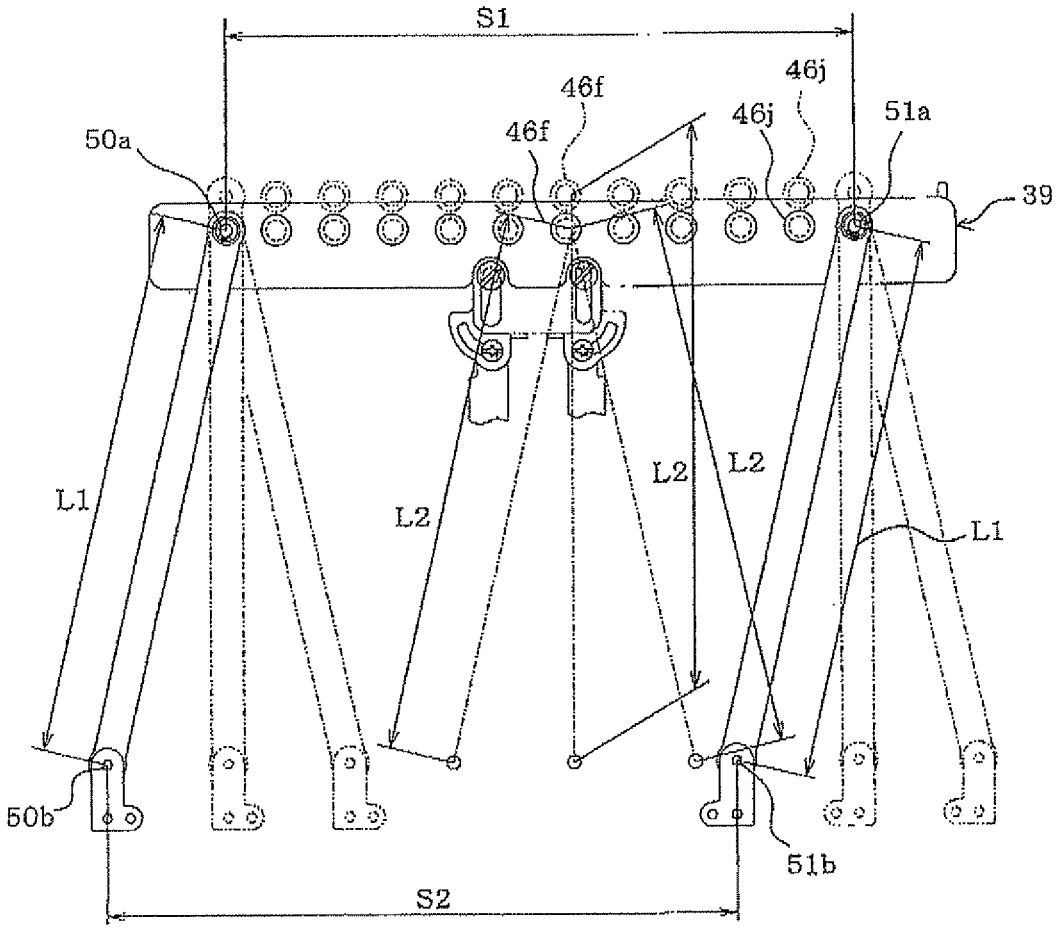
FIG. 22 indicates relative dimensions of the components of the lifting/lowering mechanism.

The distance between the pivotal axes of the first link member 54 and the second link member 51 are equal and is represented as L1 in FIG. 22. The upper end of second link member 51 is pivotably coupled to the right end of thread guide member 39 by way of shaft 51*a*, whereas the lower end of the second link member 52 is pivotably coupled to attachment 54 mounted on the right end of needle-bar case 5 by way of shaft 51*b*. The distance between each of thread guides 46*a* to 46*b* and thread inlets 13*a* to 13*j*, represented as L2, is also equivalent to L1.

As shown in FIG. 22, distance S1 between shaft 50*a* and 51*a* and distance 52 between shaft 50*b* and 51*b* are specified to be equal. Thread guide member 39, the first link member 50, the second link member 51, and needle-bar case 5 are one exemplary component of a parallel link mechanism.

Auxiliary member 52 is pivotably coupled to the lengthwise mid portion of the first and the second link members 50 and 51 by way of shafts 52*a* and 52*b*. The distance between shafts 52*a* and 52*b* of auxiliary member 52 is equal to the distance between shaft 50*a* and 51*a* and between shaft 50*b* and 51*b*.

Auxiliary member 52 is provided with projection 52*c* projecting substantially in a horizontal direction. Projection 520 has auxiliary thread guides 55*a* to 55*j* formed, as a vertical through hole. The center of each of auxiliary thread guides 55*a* to 55*j* are located on an imaginary line of extension of the center of each of thread guides 46*a* to 46*j* of thread guide member 39 and the centers of each of thread inlets 13*a* to 13*j*.

As shown in FIGS. 1 and 4, thread (needle thread) Ta is drawn upward from thread spool 23*a* and is passed through thread engagement section 48*a* of thread engagement member 47 and then through thread guide section 46*a* of thread guide member 39.

Thread Tb is drawn upward from thread spool 23*b* and is passed through thread engagement sections 48*b*' and 48*b* of thread engagement member 47 and then through thread guide section 46*b* of thread guide member 39.

Thread. To is drawn upward from thread spool 23*c* and is passed through thread engagement sections 48*c*' and 48*c* of thread engagement member 47 and then through thread guide section 46*o* of thread guide member 39.

Thread Td is drawn upward from thread spool 23*d* and is passed through thread engagement sections 48*d*' and 48*d* of thread engagement member 47 and then through thread guide section 46*d* of thread guide member 39.

Needle thread Te is drawn upward from thread spool 23*e* and is passed through thread engagement section 48*e* of thread engagement member 47 and then through thread guide section 46*e* of thread guide member 39.

Needle thread Tf is drawn upward from thread spool 23*f* and is passed through thread engagement section 48*f* of thread engagement member 47 and then through thread guide section 46*f* of thread guide member 39.

Needle thread Tg is drawn upward from thread spool 23*g* and is passed through thread engagement sections 48*g*' and 48*g* of thread engagement member 47 and then through thread guide section 46*g* of thread guide member 39.

Needle thread Th is drawn upward from thread spool 23*h* and is passed through thread engagement sections 48*h*' and 48*h* of thread engagement member 47 and then through thread guide section 46*h* of thread guide member 39.

Needle thread Ti is drawn upward from thread spool 23*i* and is passed through thread engagement sections 48*i*' and 48*i* of thread engagement member 47 and then through thread guide section 46*i* of thread guide member 39.

Needle thread Tj is drawn upward from thread spool 23*j* and is passed through thread engagement sections 48*j*' and 48*j* of thread engagement member 47 and then through thread guide section 46*j* of thread guide member 39.

Referring to FIGS. 19 to 22, threads Ta to TJ introduced through each of thread guide sections 46*a* to 46*j* of thread guide member 39 is passed through auxiliary thread guide sections 55*a* to 55*j*, thread inlets 13*a* to 13*j*, thread guides 14*a* to 14*j*, thread tension regulators 15*a* to 15*j*, and thread take-ups 11 etc., to be passed through eyes not shown of sewing needles 10*a* to 10*j*.

Thread guide sections 46*a* to 46*j* are associated with thread inlets 13*a* to 13*j*.

Threads Ta to Tj are lead to sewing needles 10*a* to 10*j* in a stretched manner and thus, are substantially tensed in a straight line between thread guide sections 46*a* to 46*j* and the corresponding thread inlets 13*a* to 13. Threads Ta to Tj are arranged to be parallel with each other.

Next, the configuration of a control system of the present exemplary embodiment will be discussed with reference to the block diagram shown in FIG. 26. Controller 56 is configured primarily by a microcomputer. Controller 56 includes CPU 56*a*, ROM 56*b*, RAM 56*c*, EEPROM 56*d*, input/output (I/O) interface 56*e*, and data bus 56*f* interconnecting the foregoing components. I/O interface 56*e* establishes connections with start/stop switch 6*b*, card connector 6*d* and touch panel 6*e*. I/O interface 56*e* also establishes connection with drive circuits 58 to 61 for driving sewing machine motor 57, needle-bar case transfer motor 21, LCD 6*a*, and buzzer 6*c*, respectively.

Controller 56 controls the drive of various actuators such as sewing machine motor 57 and needle-bar case motor 21 based on the instructions given by sewing control program to execute transfer of needle-bar case 5 to transfer needle bars 9*a* to 9*j* to the sewing position and to execute the sewing operation on workplace cloth.

Next, a description will be given on the working of the above described configuration. Controller 56 operates needle-bar case transfer mechanism 16 based on control signals given to it to transfer one of needle bars 9*a* to 9*j* within needle-bar case 5 to sewing position P shown in FIG. 5. The solid line in FIG. 5 illustrates the leftmost position where needle bar 9*j* is located at sewing position P whereas the double-dot chain line in FIG. 5 illustrates the rightmost position where needle bar 9*a* is located at sewing position P.

Figure 23:
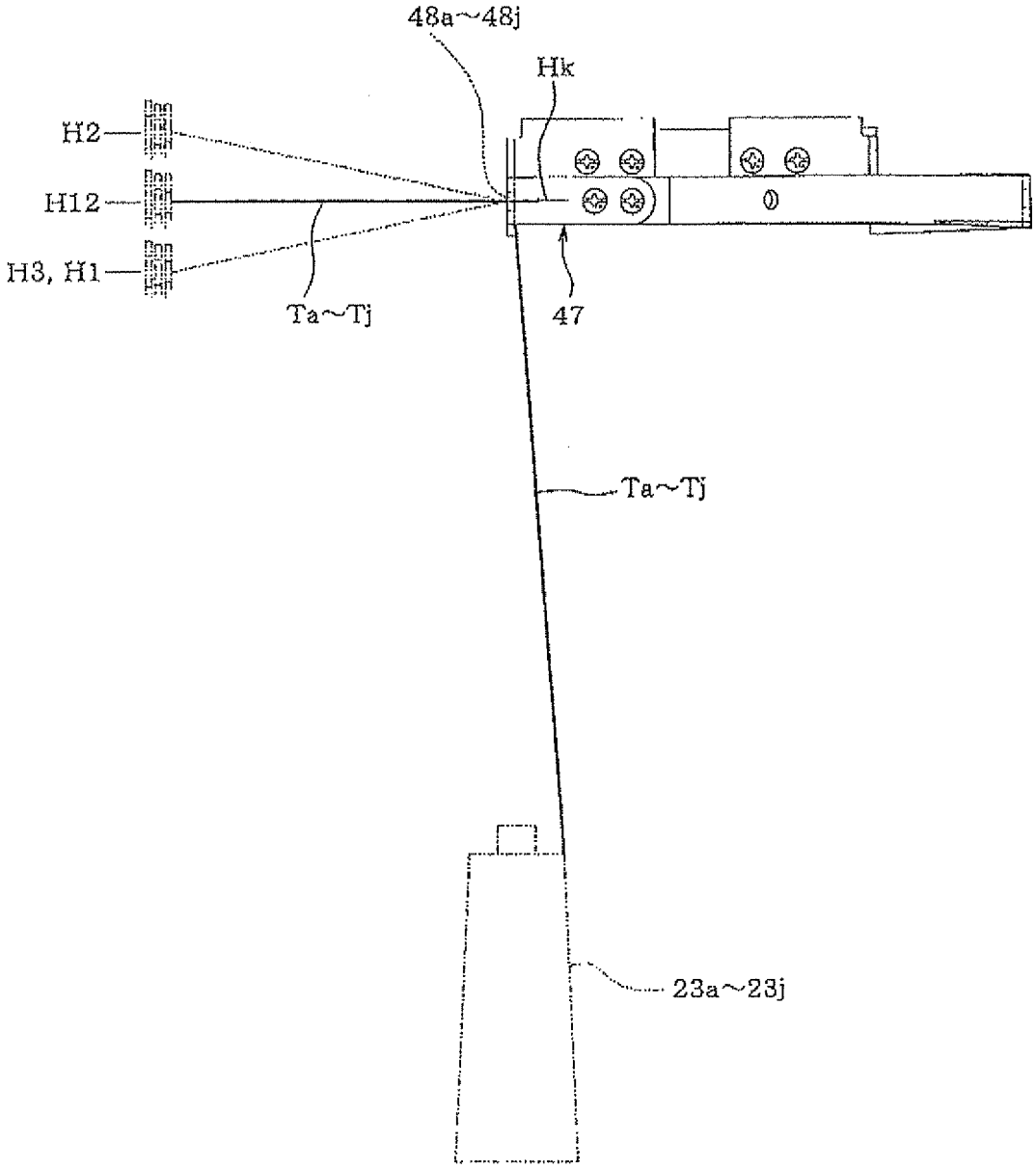
FIG. 23 indicates relative heights of a thread engagement member and the thread guide member.

When needle-bar case 5 is in the leftmost position illustrated by solid line in FIG. 5, lifting/lowering mechanism 49 is placed in the state shown in FIG. 19 where the lower ends of the first and the second link members 50 and 51 are located on the left side of their upper ends such that first and the second link members 50 and 51 extend at an angle. In the state illustrated in FIGS. 5 and 19, the height from a given reference point not shown of fixture frame 3*a* to the centers of thread guide sections 46*a* to 46*j* of thread guide member 39 has a measurement of H1 as indicated in FIGS. 19 and 23.

Figure 20:
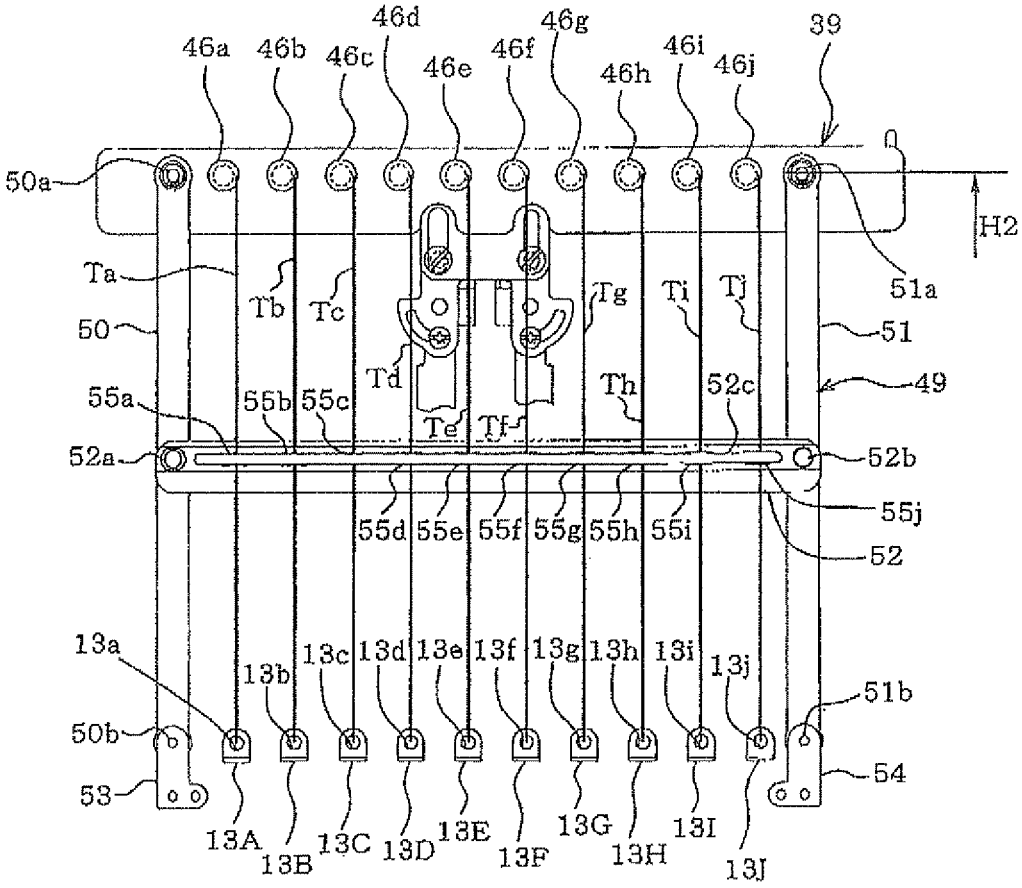
FIG. 20 is another front view of lifting/lowering mechanism which is a variation of FIG. 19.
Figure 21:
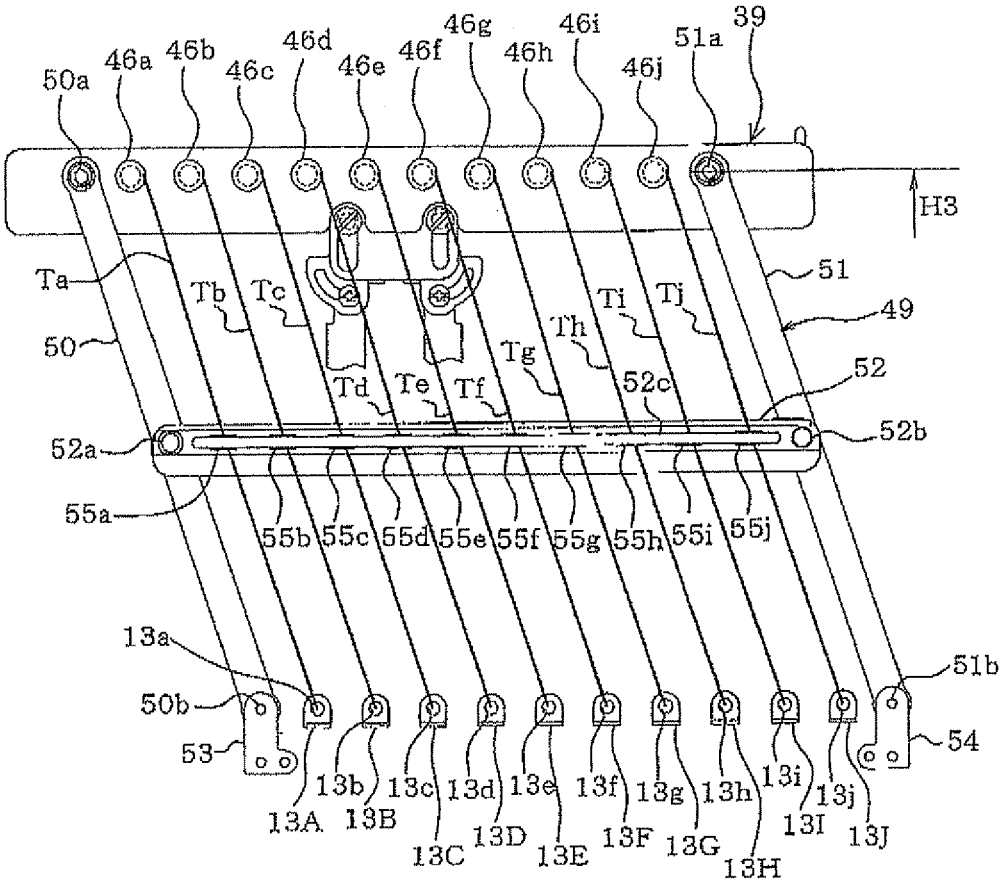
FIG. 21 is yet another front view of lifting/lowering mechanism which is a variation of FIGS. 19 and 20.

When needle-bar case 5 is moved in the direction indicated by arrow R or the right side from the state shown in FIGS. 5 and 19, the lower ends of the first and the second link members 50 and 51 of lifting/lowering mechanism 49 moves in the direction indicated by arrow D to proceed to the state shown in FIG. 20 and then to the rightmost position illustrated in FIG. 21. Thread guide member 39 is movable up and down and is connected to the upper ends of the first and second link members 50 and 51. Further, because the lengths of the first and the second link members 50 and 51 are constant, thread guide member 39 moves upward while the lower ends of the first and second link members 50 and 51 are transferred to the positions corresponding to the intermediate, position of needle-bar case 5. The intermediate position is a position where the first and second link members 50 and 51 are upright as shown in FIG. 20. The height from the reference point of fixture frame 3*a* to the center of thread guide sections 46*a* to 46*j* of thread guide member 39 has a measurement of H2 as indicated in FIGS. 20 and 23.

While needle-bar case 5 is transferred from the position shown in FIG. 20 to the rightmost position shown in FIG. 21, the lower ends of the first and second link members 50 and 51 move to the right. Thus, the upper ends of the first and second link members 50 and 51 move downward. The height from the reference point of fixture frame 3*a* to the center of thread guide sections 46*a* to 46*j* of thread guide member 39 is specified to H3 shown in FIGS. 21 and 23 which is equal to H1 (H1=H3). Height H2 measured at the position shown in FIG. 20 is greater than H1 (H2>H1). The substantial midpoint of the distance or the range of up and down movement of thread guide sections 46*a* to 46*j* represented as mid height H12 in FIG. 23 is given by the [(H2−H1)/2]+H1. Height Hk representing the height of the center of thread engagement section 48*a* to 48*e* of thread engagement member 47 shown in FIG. 23 is specified to be equal to mid height H12 of thread guide sections 46*a* to 46*j*.

During the transfer of needle-bar case 5, distance L2 between the corresponding thread guide sections 46*a* to 46*j* and thread inlets 13*a* to 13*j* is maintained substantially constant or equal to distance L1 by lifting/lowering mechanism 49 provided with the first and the second link members 50 and 51.

Thus, the length of threads Ta to Tj running between thread guide sections 46*a* to 46*j* and the corresponding thread inlets 13*a* to 13*j* during the transfer of needle-bar case 5 is also maintained substantially constant.

This prevents loosening of threads Ta to Tj as well as tangling of neighboring threads. Because the mid portions of threads Ta to Tj are guided by auxiliary sections 55*a* to 55*j*, the mid portions of threads Ta to Tj can be stabilized.

Because threads Ta to Tj merely need to be passed through thread guide sections 46*a* to 46*j*, auxiliary thread guide sections 55*a* to 55*j* and thread inlets 13*a* to 13*j*, the troublesome task of passing each thread through a thin tube can be eliminated.

According to the first exemplary embodiment, because the lifting/lowering mechanism 49 is configured by a parallel link mechanism comprising thread guide member 39 and needle-bar case 5 linked by the first and the second link members 50 and 51, thread guide member 39 can be lifted/lowered smoothly in a simple and low cost configuration.

Further according to the first exemplary embodiment, because the mid portions of threads Ta to Tj are passed through thread guide sections 46*a* to 46*j* and the corresponding thread inlets 13*a* to 13*j*, the mid portions of threads Ta to Tj can be stabilized as earlier described. As a result, threads Ta to Tj can be moved more steadily to prevent thread tangling more reliably.

Still further according to the first exemplary embodiment, thread engagement member 47 is provided behind thread guide member 39 of fixture frame 3*a*. Thread engagement member 47 is also provided with an alignment of thread engagement sections 48*a* to 48*j* and 48*g*', 48*i*', 48*h*', 48*d*', 48*b*', and 48*c*' that are located above thread spools 23*a* to 23*j*. Threads Ta to Tj drawn upward from thread spools 23*a* to 23*j* are thus, lead to thread insert holes 40*a* to 40J defined on thread guide member 39 by way of thread engagement sections 48*a* to 48*j* and 48*g*', 48*i*', 48*h*', 48*d*', 48*b*' and 48*c*'. Thus, threads Ta to Tj drawn from thread spools 23*a* to 23*j* can be guided to thread guide sections 46*a* to 46*j* without tangling.

Yet further according to the first exemplary embodiment, height Hk of thread engagement sections 48*a* to 48*j* are specified so as to be substantially equal to the substantial midpoint 1112 of the distance or the range of up and down movement of thread guide sections 46*a* to 46*j*, i.e., the center of the area covered by the up and down movement of thread guide sections 46*a* to 46*j*. Thus, as shown in FIGS. 2 and 3, the variation in the length of threads Ta to Tj running between thread guide member 39 and the thread engagement member 47 located behind it can be minimized when thread guide member 39 is lifted/lowered with the transfer of needle-bar case 5. Though threads Ta to Tj running between thread engagement member 47 and thread spools 23*a* to 23*j* may slack by the lifting/lowering of thread guide member 39, because the slack occurs almost directly above thread spools 23*a* to 23*j*, there is no risk of threads Ta to Tj tangling with each other.

FIGS. 27 to 30 illustrate a second exemplary embodiment of the present disclosure. The second exemplary embodiment differs from the first exemplary embodiment in the structure of support frame represented by reference symbol 70 in the second exemplary embodiment and lifting/lowering mechanism represented by reference symbol 71 in the second exemplary embodiment. Support frame 70 is configured, for instance, by an element such as a columnar member having a U-shaped cross section and a pipe having an angular or round cross section. Thread guide member 39 is provided with attachment 40*k* having long holes 43A' and 43B' aligned in a vertical single file line. Thread guide member 39 is provided so as to be movable up and down at the upper end of support frame 70 by threading stepped screws 38A and 38B into long holes 43A' and 43B' and through screw holes not shown provided on support frame 70.

Lifting/lowering mechanism 71 includes lifting/lowering motor 72, rack 73, pinion 74, and controller 75. Lifting/lowering motor 72 is configured, for instance, by a permanent magnet rotary brushless motor or a step motor and is mounted on support frame 70. On the rotary shaft of lifting/lowering motor 72, pinion 74 is mounted so as to rotate integrally with it. Rack 73 is provided on the side edge of elongate panel 40*i* formed at the lower portion of attachment 40*k* of thread guide member 39. Rack 73 is meshed with pinion 74.

The hardware configuration of controller 75 is identical to those of controller 65 of the first exemplary embodiment and is represented by identical reference symbols. Controller 75 constantly monitors the location of needle-bar case 5 from the result of control executed by it. When transferring needle-bar case 5, lifting/lowering motor 72 is controlled through drive circuit 76 depending upon the current location of needle-bar 5 to move thread guide member 39 to the predetermined height associated with the location of needle-bar case 5.

Figure 27:
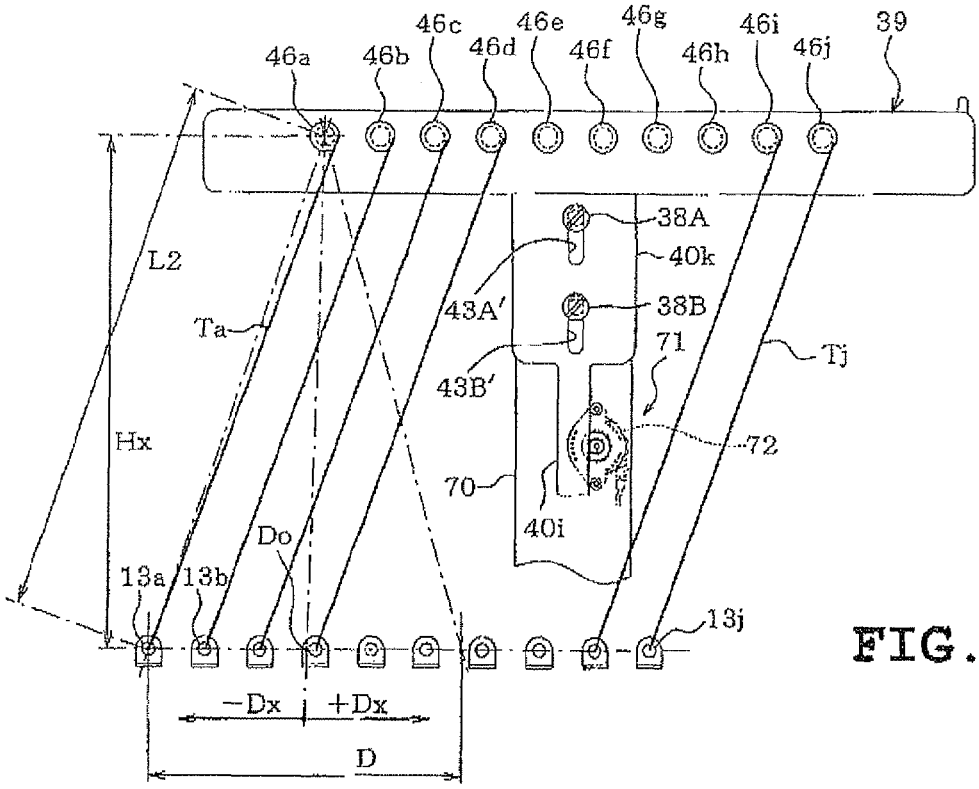
FIG. 27 is a front view of lifting/lowering mechanism according to a second exemplary embodiment.
Figure 28:
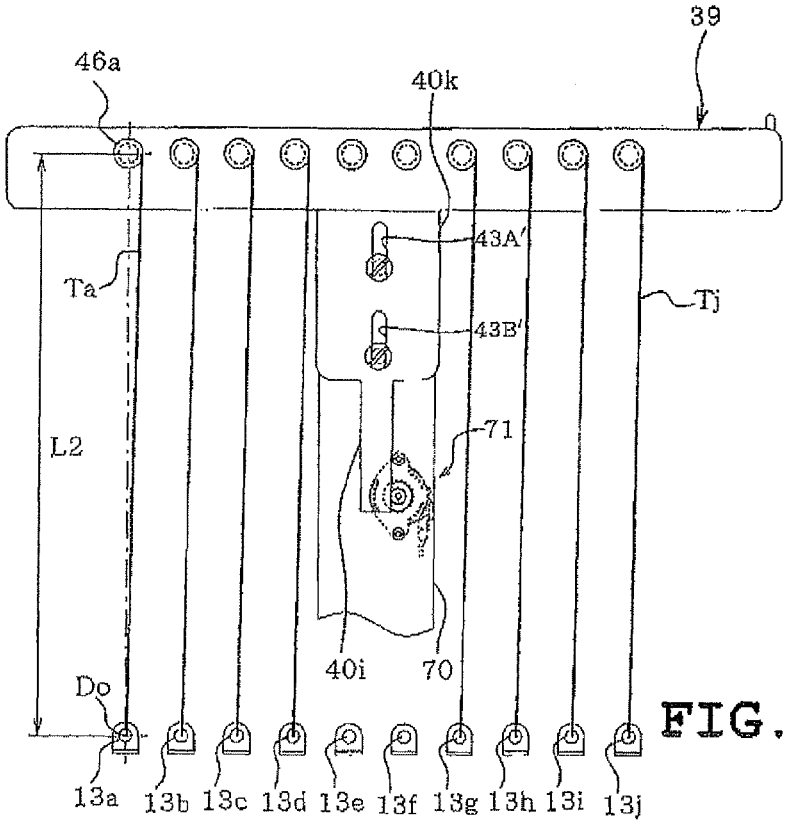
FIG. 28 is a front view of lifting/lowering mechanism which is a variation of FIG. 27.
Figure 29:
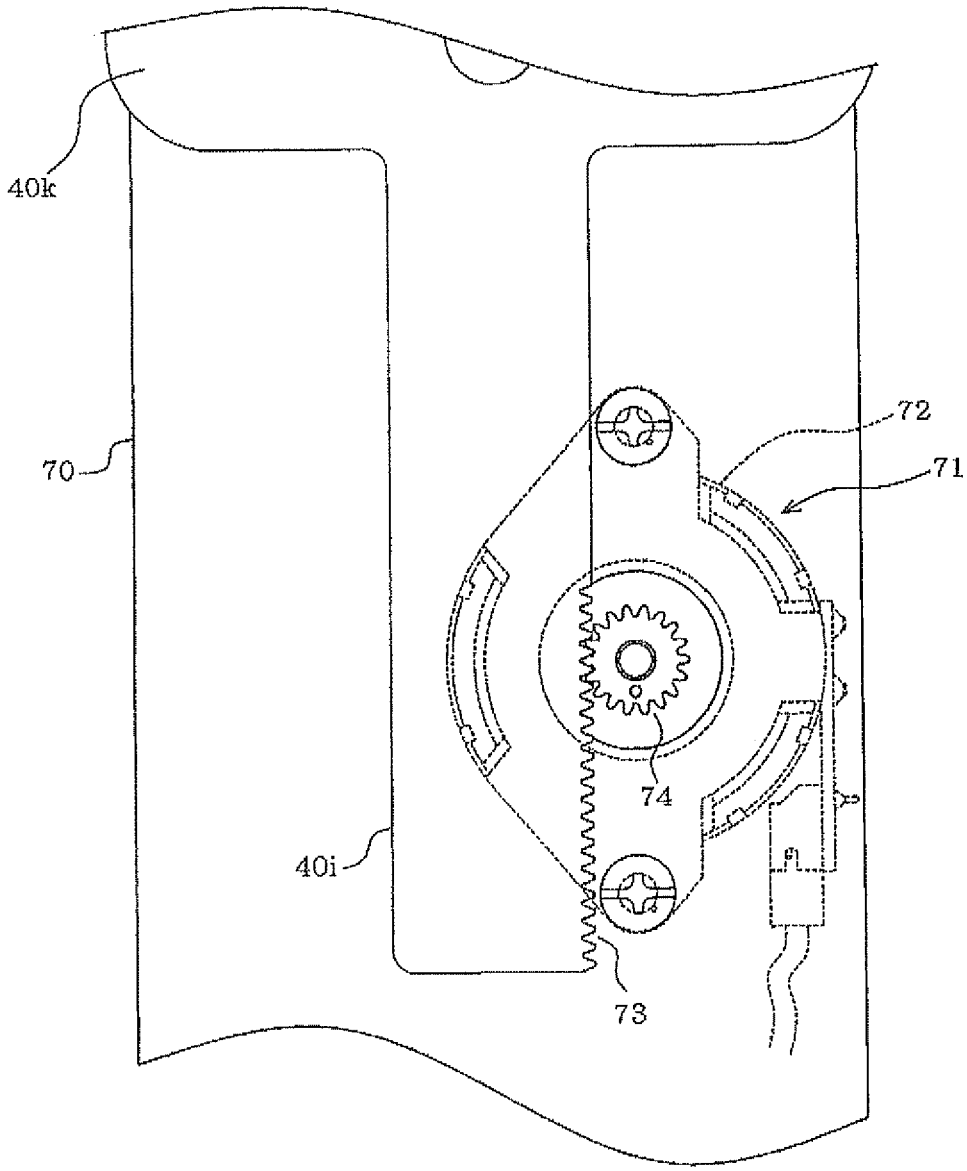
FIG. 29 is an enlarged front view of a lifting/lowering motor.
Figure 30:
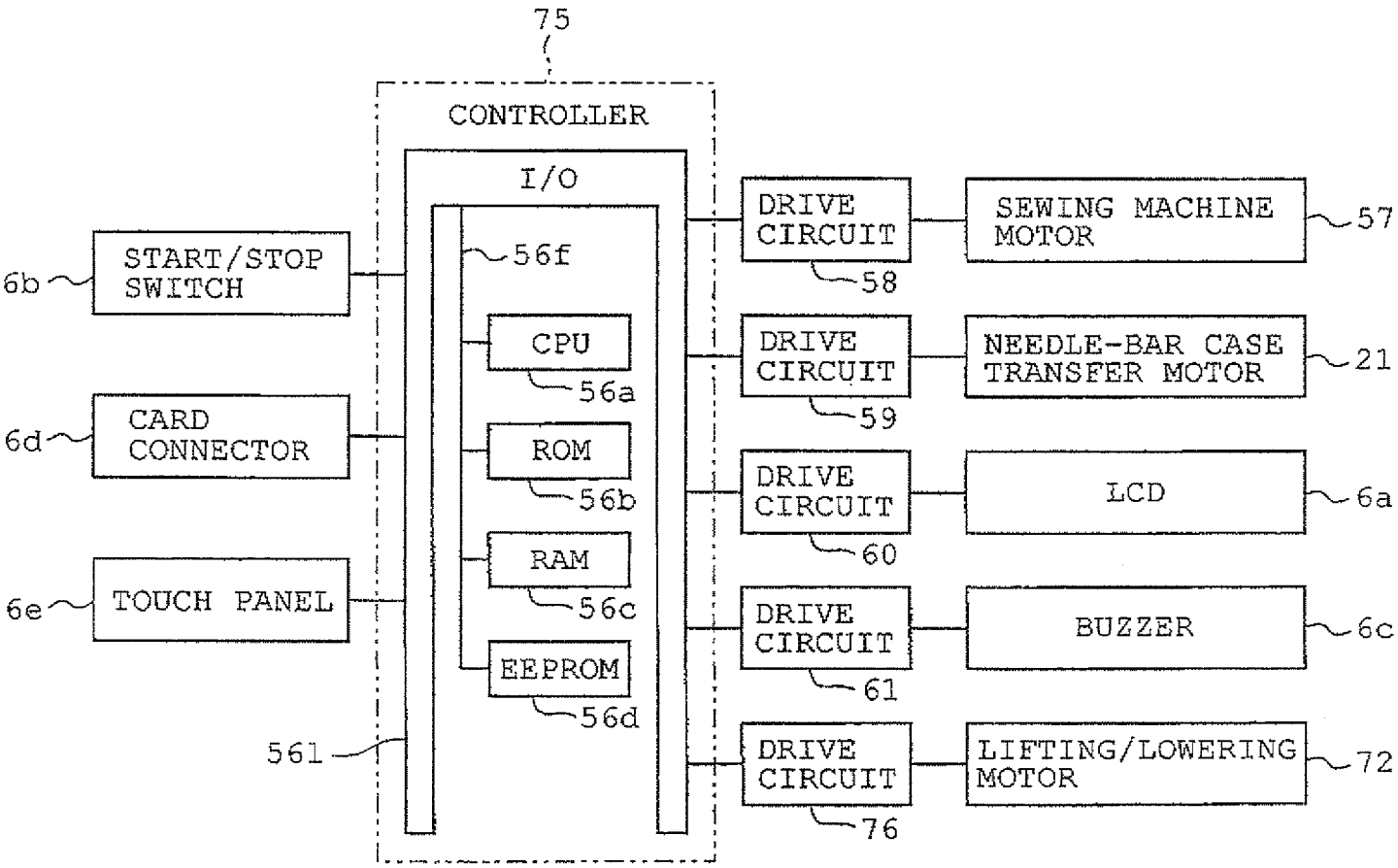
FIG. 30 is a block diagram of a control system of the multi-needle sewing machine according to a second exemplary embodiment.
Figure 31:
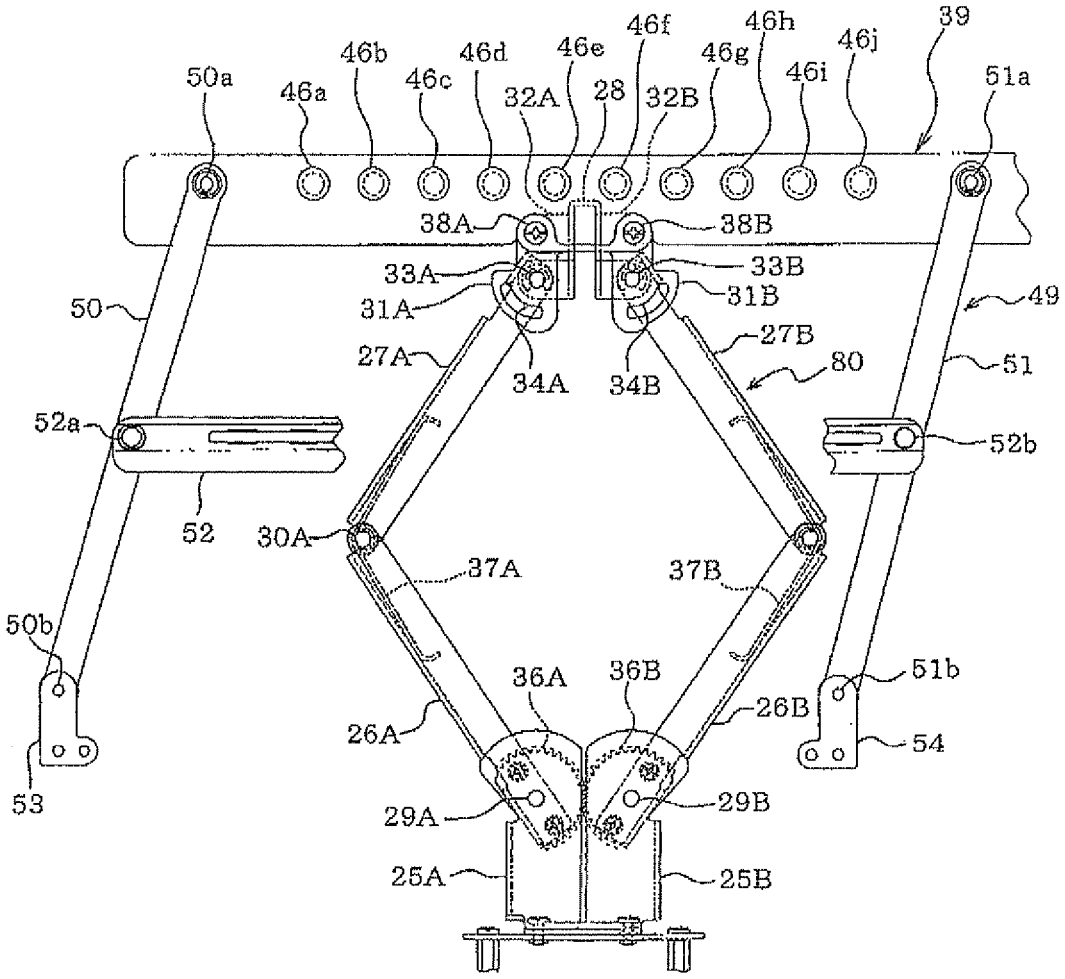
FIG. 31 is a front view of the support frame according to a third exemplary embodiment.
Figure 32:
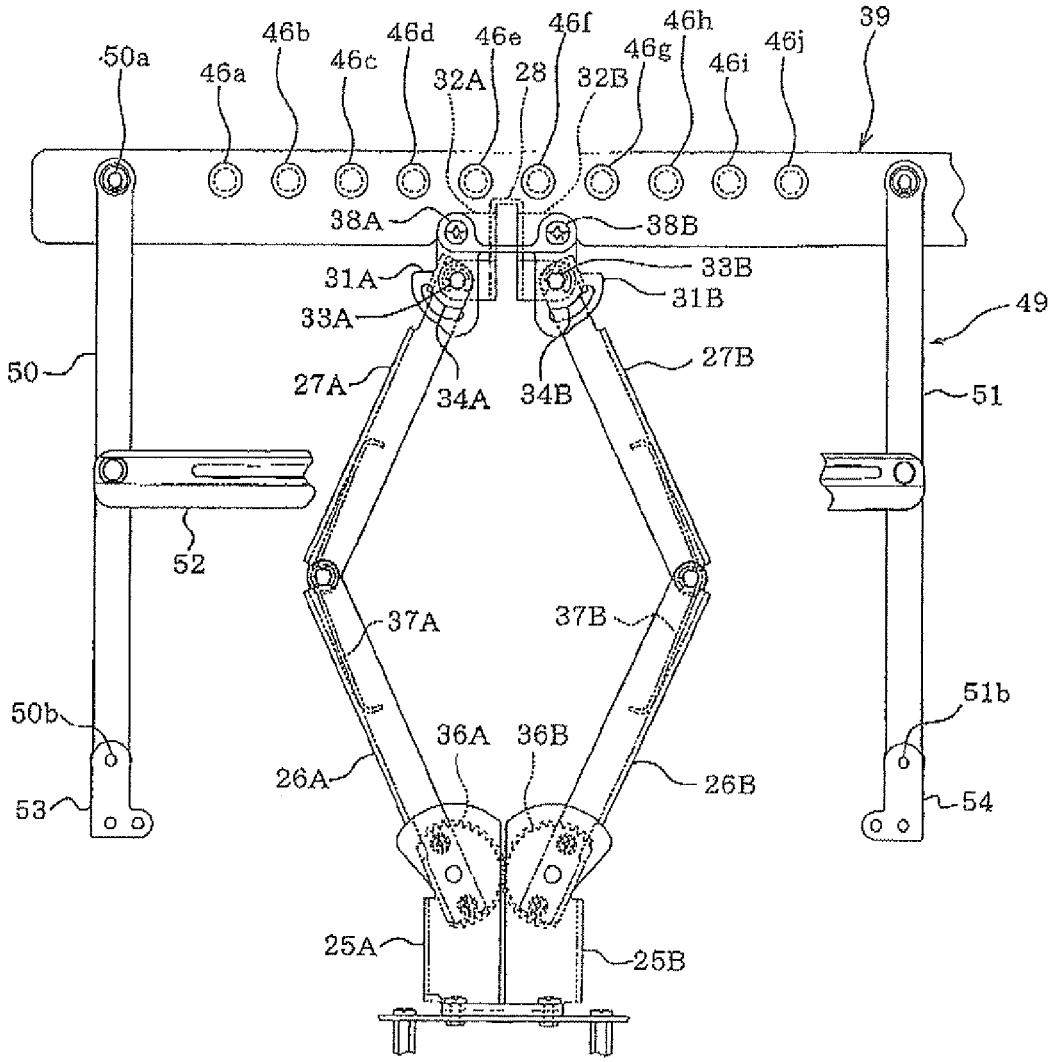
FIG. 32 is another front view of the support frame which is a variation to FIG. 31.

As show in FIG. 27, for instance, if: (1) the distance or the range of lateral movement of needle-bar case 5 is represented by D [mm]; (2) the midpoint of the range of lateral movement of thread inlet 13*a* is represented by mid point D0; and (3) the distance from D0 to the center of corresponding thread guide section 46*a* to 46*j* is represented by L2 [mm], height Hx measured at the center of thread guide section 46*a* based on given distance +Dx or −Dx taken to the left or right of mid point D0 can be given by the following equation (1).

$$Hx^2=L2^2-Dx^2$$

$$Hx=\sqrt{L2^2-Dx^2} \quad (1)$$

The drive of lifting/lowering motor 72 is controlled to meet equation (1).

According the second exemplary embodiment, lifting/lowering mechanism controls the up and down movement of thread guide member 39 based on the control of lifting/lowering motor 72. Thus, the height of thread guide member 39 relative to thread inlets 13*a* to 13*j* or the height of thread guide section 39 itself can be readily adjusted.

FIGS. 31 to 34 illustrate a third exemplary embodiment of the present disclosure. In the first exemplary embodiment, support frame 24 was configured as a stationary support frame and the components of support frame 24 were not allowed to move while the sewing machine was under operation. Support frame 80 according to the third exemplary embodiment utilizes most of the components used in and support frame 24 of the first exemplary embodiment and thus, the reused components will not be re-described. The third exemplary embodiment eliminates long holes 43A and 43B provided at thread guide member 39 in the first exemplary embodiment but instead, secures thread guide member 39 to upper frame section attachments 31A and 31B provided at upper support section 28 located at the upper end of support frame 80.

Though support frame 80 reuses most of its structural components from support frame 24, the components differ in their functionality in support frame 80. That is, support frame 80 eliminates screws 35A and 355 provided in the first exemplary embodiment. Thus, upper frame section 27A and 27B are pivotable around shafts 33A and 335 relative to upper frame section attachments 31A and 31B of upper support section 28. The upper ends of upper frame sections 27A and 27B are pivotable relative to thread guide member 39 to which upper section attachments 31A and 31B of upper support section 28 is secured. The lower ends of upper frame sections 27A and 27B are pivatable relative to the upper ends of lower frame sections 26A and 26B, whereas the lower ends of lower frame sections 26A and 263 are pivotable relative to fixture frame 3*a*.

Sector gear 36 and 36B regulate lower frame sections 26A and 26B to pivot laterally symmetrically. Thus, the upper end of support frame 80, that is the upper ends of upper frame sections 27A and 27B move in the vertical direction. According to the above described configuration, thread guide member 39 is allowed to move up and down by the up and down movement of the upper ends of upper frame sections 27A and 27B during the transfer of needle-bar case 5.

Figure 33:
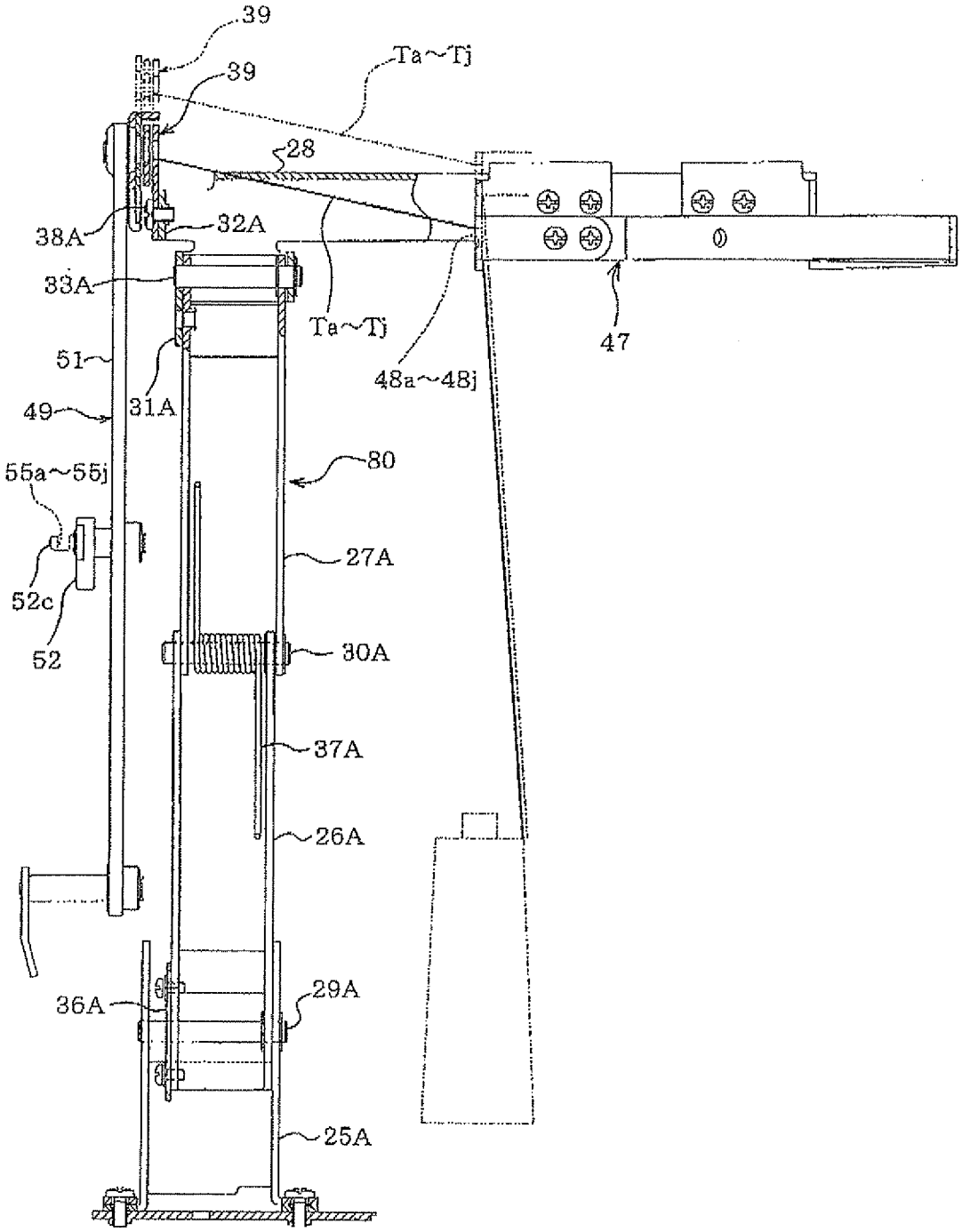
FIG. 33 is a side view of the support frame.

Thread engagement member 47 is mounted on the rear side of upper support section 28 of support frame 80. Thus, thread engagement member 47 is moved up and down integrally with thread guide member 39 as shown in FIG. 33.

According to the third exemplary embodiment, because the upper end of support frame 80 is arranged to be movable up and down, thread guide member 39 is guided so as to be movable up and down by the upper end of support frame 80. Thus, even if the vertical movable range of thread guide member 39 is modified, thread guide member 39 can readily adapt to such modification, whereas a stationary support frame requires modification in the height of support frame when the vertical movable range is modified. The third exemplary embodiment advantageously eliminates such troublesome task.

Further according to the third exemplary embodiment, thread engagement member 47 is provided on the rear side of thread guide member 39. Thread engagement member 47 is integrally provided with an alignment of a plurality of thread engagement sections 48*a* to 48*j*. Thread engagement sections 48*a* to 48*j* are provided above thread spools 23*a* to 23*j*. The plurality of threads Ta to Tj drawn upward from thread spools 23*a* to 23*j* and lead to thread guide sections 46*a* to 46*j* are guided by thread engagement sections 48*a* to 48*j*. Because thread guide member 39 and thread engagement member 47 are moved integrally, the variation in length of threads Ta to Tj passing through thread guide member 39 and thread engagement member 47 provided integrally on its rear side can be prevented even when thread guide member 39 is moved up and down with the transfer for needle-bar case 5.

Figure 34:
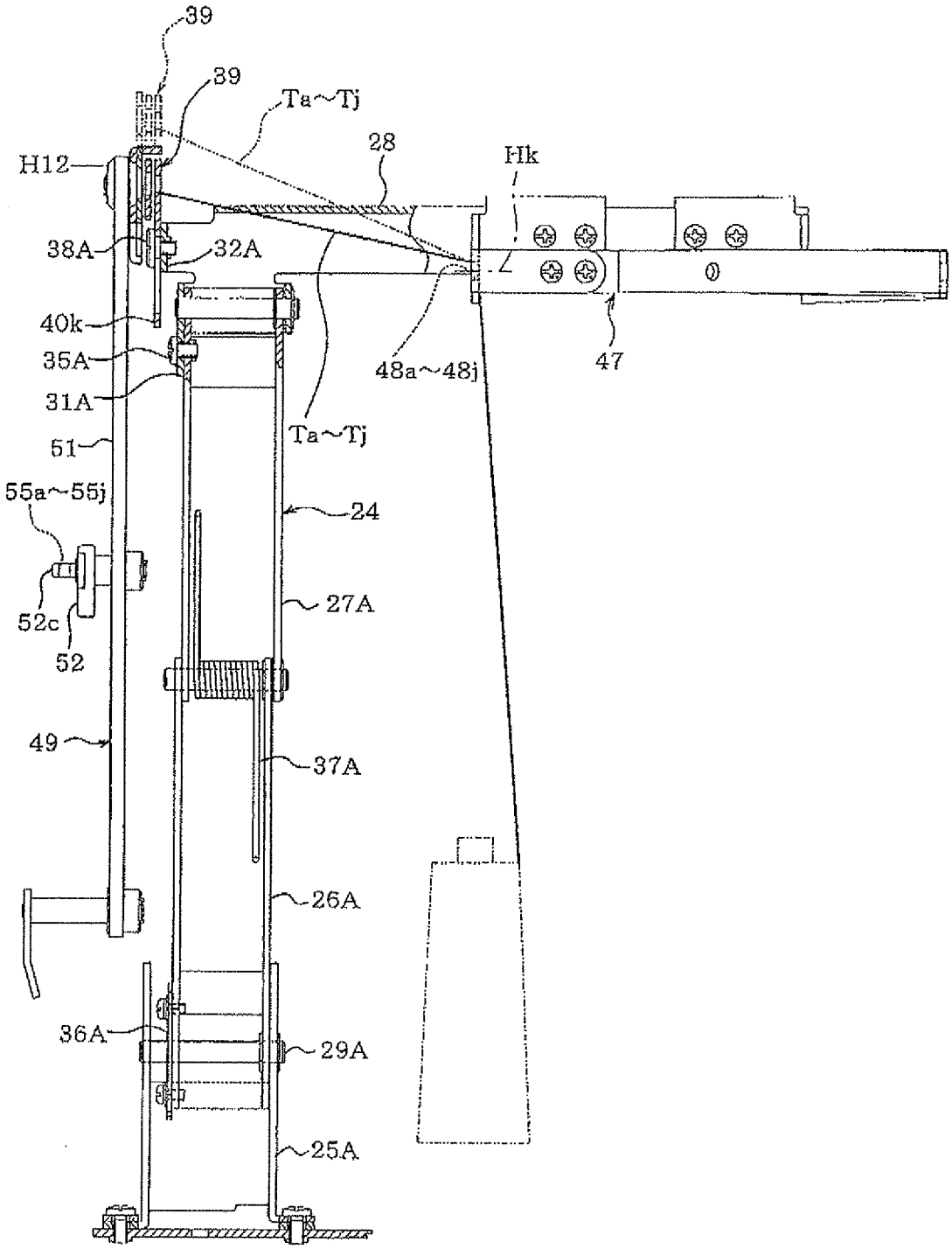
FIG. 34 is a side view indicating relative heights of the thread engagement member and the thread guide member according to a fourth exemplary embodiment.

FIG. 34 illustrates a fourth exemplary embodiment of the present disclosure which differs from the first exemplary embodiment in the height of thread engagement sections 48*a* to 48*j*. In the first exemplary embodiment, height Hk of thread engagement sections 48*a* to 48*j* have been arranged to be substantially level with mid point H12 which substantially resides at the midpoint of the range of up and down movement of thread guide sections 46*a* to 46*j*, i.e., the center of the area. Covered by the up and down movement of thread guide sections 46*a* to 46*j*. In the fourth exemplary embodiment, height Hk of thread engagement sections 48*a* to 48*j* need not be arranged to be level with mid height H12.

The present disclosure is not limited to the foregoing exemplary embodiments but may be expanded or modified as required. For instance, the present disclosure may be applied to a multi-needle sewing machine provided with more than or less than ten needle bars. The layout or distribution of thread spools, and configuration of components of such as the thread guide member and the thread engagement members can be modified as required. The selection, material, and other small details of the components of the lifting/lowering mechanism may be modified as required as long as the thread guide member can be moved up and down with the distance between each thread guide section and the corresponding thread inlet can be kept constant during the transfer of thread inlet with needle-bar case 5.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A multi-needle sewing machine comprising:

a plurality of needle bars, each of the plurality of needle bars being configured to receive a sewing needle at a lower end thereof;

a needle-bar case that supports the needle bars so as to be movable up and down;

a needle-bar case transfer mechanism that transfers the needle-bar case to place a predetermined needle bar selected from the plurality of needle bars to a needle drop position;

a sewing machine frame;

a support frame that supports the sewing machine frame;

a thread guide member that is movable up and down and that is provided on an upper end of the support frame, the thread guide member being provided with a plurality of thread guide sections that are spaced by a predetermined distance and that is configured to guide a plurality of threads being drawn from a plurality of thread spools provided at the sewing machine frame;

a plurality of thread inlets that are provided at the needle-bar case, each of the thread inlets being associated with corresponding each of the thread guide sections and that is configured to introduce the threads guided by the thread guide sections toward the needle bars; and a lifting/lowering mechanism that moves the thread guide member up and down during transfer of the needle-bar case and the thread inlets such that the thread guide sections and the associated thread inlets maintain a constant distance therebetween.

2. The multi-needle sewing machine according to claim 1, wherein the lifting/lowering mechanism includes a first link member that pivotably couples a first end of the thread guide member with a first end of the needle-bar case, and a second link member that pivotably couples a second end of the thread guide member with a second end of the needle-bar case, wherein the thread guide member, the first link member, the second link member and the needle-bar case are interlinked so as to define a parallel link mechanism.

3. The multi-needle sewing machine according to claim 2, wherein the lifting/lowering mechanism includes an auxiliary member that is pivotably coupled to a lengthwise midpoint of the first link member and a lengthwise midpoint of the second link member, wherein the auxiliary member is provided with an alignment of a plurality of auxiliary thread guide sections that are configured to guide intermediate portions of the threads being passed through the thread guide sections and the associated thread inlets.

4. The multi-needle sewing machine according to claim 1, wherein the lifting/lowering mechanism includes an actuator that moves the thread guide member up and down, and a controller that controls drive of the actuator in coordination with the transfer of the needle-bar case.

5. The multi-needle sewing machine according to claim 1, wherein the support frame includes an upper frame section that has an upper end pivotably coupled to the thread guide member, and a lower frame section that has a lower end pivotably coupled to the sewing machine frame, and wherein a lower end of the upper frame section and an upper end of the lower frame section are pivotably coupled such that the thread guide member is moved up and down as the upper end of the upper frame section is moved up and down.

6. The multi-needle sewing machine according to claim 1, further comprising a thread engagement member that is located behind the thread guide member and above the thread spools and that is provided with an alignment of a plurality of thread engagement sections that are configured to guide the threads drawn upward from the thread spools toward the thread guide sections, wherein the thread engagement sections are located so as to be substantially at level with a midpoint of the up and down movement of the thread guide sections.

7. The multi-needle sewing machine according to claim 2, further comprising a thread engagement member that is located behind the thread guide member and above the thread spools and that is provided with an alignment of a plurality of thread engagement sections that are configured to guide the threads drawn upward from the thread spools toward the thread guide sections, wherein the thread engagement sections are located so as to be substantially at level with a midpoint of the up and down movement of the thread guide sections.

8. The multi-needle sewing machine according to claim 3, further comprising a thread engagement member that is located behind the thread guide member and above the thread spools and that is provided with an alignment of a plurality of thread engagement sections that are configured to guide the threads drawn upward from the thread spools toward the thread guide sections, wherein the thread engagement sections are located so as to be substantially at level with a midpoint of the up and down movement of the thread guide sections.

9. The multi-needle sewing machine according to claim 4, further comprising a thread engagement member that is located behind the thread guide member and above the thread spools and that is provided with an alignment of a plurality of thread engagement sections that are configured to guide the threads drawn upward from the thread spools toward the thread guide sections, wherein the thread engagement sections are located so as to be substantially at level with a midpoint of the up and down movement of the thread guide sections.

10. The multi-needle sewing machine according to claim 5, further comprising a thread engagement member that is located behind the thread guide member and above the thread spools and that is provided with an alignment of a plurality of thread engagement sections that are configured to guide the threads drawn upward from the thread spools toward the thread guide sections, wherein the thread engagement sections are located so as to be substantially at level with a midpoint of the up and down movement of the thread guide sections.

11. The multi-needle sewing machine according to claim 1, further comprising a thread engagement member that is provided integrally with a rear section of the thread guide member and above the thread spools, the thread engagement member being provided with an alignment of a plurality of thread engagement sections that are configured to guide the threads drawn upward from the thread spools toward the thread guide sections.

12. The multi-needle sewing machine according to claim 2, further comprising a thread engagement member that is provided integrally with a rear section of the thread guide member and above the thread spools, the thread engagement member being provided with an alignment of a plurality of thread engagement sections that are configured to guide the threads drawn upward from the thread spools toward the thread guide sections.

13. The multi-needle sewing machine according to claim 3, further comprising a thread engagement member that is provided integrally with a rear section of the thread guide member and above the thread spools, the thread engagement member being provided with an alignment of a plurality of thread engagement sections that are configured to guide the threads drawn upward from the thread spools toward the thread guide sections.

14. The multi-needle sewing machine according to claim 4, further comprising a thread engagement member that is provided integrally with a rear section of the thread guide member and above the thread spools, the thread engagement member being provided with an alignment of a plurality of thread engagement sections that are configured to guide the threads drawn upward from the thread spools toward the thread guide sections.

15. The multi-needle sewing machine according to claim 5, further comprising a thread engagement member that is provided integrally with a rear section of the thread guide member and above the thread spools, the thread engagement member being provided with an alignment of a plurality of thread engagement sections that are configured to guide the threads drawn upward from the thread spools toward the thread guide sections.

* * * * *